US010971850B2

(12) United States Patent
Shioda et al.

(10) Patent No.: US 10,971,850 B2
(45) Date of Patent: Apr. 6, 2021

(54) MOVABLE CONNECTOR

(71) Applicant: IRISO ELECTRONICS CO., LTD., Kanagawa (JP)

(72) Inventors: Hideki Shioda, Kanagawa (JP); Yoshihito Ohkuma, Kanagawa (JP)

(73) Assignee: IRISO ELECTRONICS CO., LTD., Yokohama (JP)

( * ) Notice: Subject to any disclaimer, the term of this patent is extended or adjusted under 35 U.S.C. 154(b) by 0 days.

(21) Appl. No.: 16/658,953

(22) Filed: Oct. 21, 2019

(65) Prior Publication Data

US 2020/0127405 A1 Apr. 23, 2020

(30) Foreign Application Priority Data

Oct. 23, 2018 (JP) ..... JP2018-199154
Oct. 23, 2018 (JP) ..... JP2018-199155

(51) Int. Cl.

| | |
|---|---|
| ***H01R 13/506*** | (2006.01) |
| ***H01R 13/11*** | (2006.01) |
| ***H01R 13/41*** | (2006.01) |
| ***H01R 43/24*** | (2006.01) |
| ***H01R 12/91*** | (2011.01) |

(Continued)

(52) U.S. Cl.

CPC ..... *H01R 13/506* (2013.01); *H01R 12/91* (2013.01); *H01R 13/11* (2013.01); *H01R 13/20* (2013.01); *H01R 13/41* (2013.01); *H01R 13/6315* (2013.01); *H01R 43/24* (2013.01); *H01R 12/716* (2013.01); *H01R 24/60* (2013.01); *H01R 2107/00* (2013.01)

(58) Field of Classification Search

CPC .. H01R 13/6315; H01R 13/506; H01R 13/11; H01R 13/41; H01R 13/20; H01R 43/24; H01R 12/91; H01R 12/716; H01R 24/60; H01R 2107/00

USPC ..... 439/247, 248

See application file for complete search history.

(56) References Cited

U.S. PATENT DOCUMENTS 5,788,522 A * 8/1998 Kameyama ..... H01R 13/627 439/248
5,873,742 A * 2/1999 McHugh ..... H01R 12/716 439/247

(Continued)

FOREIGN PATENT DOCUMENTS

JP 2014-067706 A 4/2014

OTHER PUBLICATIONS

Extended European search report for European Patent Application No. 19204498.0, dated Mar. 12, 2020, 8 pages.

*Primary Examiner* — Gary F Paumen
(74) *Attorney, Agent, or Firm* — Westman, Champlin & Koehler, P.A.

(57) ABSTRACT

A movable connector including a stationary housing for fixing to a substrate, a movable housing capable of moving relative to the stationary housing, and a restriction fitting that has been integrated with the stationary housing. The restriction fitting includes a counterpart engagement portion. The counterpart engagement portion is configured to abut an engagement portion that is part of the movable housing from a connector upward direction so as to enable the engagement portion to be restrained in a restraint space that is a predetermined region. The counterpart engagement portion forms a through-pass section to permit the engagement portion to pass into the restraint space from outside.

12 Claims, 34 Drawing Sheets

(51) Int. Cl.

| | |
|---|---|
| ***H01R 13/20*** | (2006.01) |
| ***H01R 13/631*** | (2006.01) |
| ***H01R 12/71*** | (2011.01) |
| ***H01R 24/60*** | (2011.01) |
| ***H01R 107/00*** | (2006.01) |

(56) References Cited

U.S. PATENT DOCUMENTS

| | | | | |
|---|---|---|---|---|
| 6,159,019 | A * | 12/2000 | Norizuki | H01R 13/516 174/72 A |
| 7,374,432 | B2 * | 5/2008 | Koguchi | H01R 12/725 439/247 |
| 7,887,350 | B2 * | 2/2011 | Fukazawa | H01R 12/707 439/247 |
| 8,257,095 | B2 * | 9/2012 | Akai | H01R 13/6315 439/74 |
| 8,911,261 | B2 * | 12/2014 | Liao | H01R 13/6658 439/660 |
| 9,088,113 | B2 | 7/2015 | Funayama et al. | |
| 9,178,326 | B2 * | 11/2015 | Funayama | H01R 12/91 |
| 9,281,594 | B2 | 3/2016 | Funayama et al. | |
| 2010/0055952 | A1 | 3/2010 | Fukazawa et al. | |
| 2012/0003875 | A1 | 1/2012 | Akai et al. | |
| 2012/0135621 | A1 * | 5/2012 | Hayauchi | H01R 12/91 439/247 |
| 2015/0064935 | A1 | 3/2015 | Funayama et al. | |
| 2015/0064975 | A1 | 3/2015 | Funayama et al. | |
| 2015/0244093 | A1 | 8/2015 | Funayama et al. | |
| 2020/0127410 | A1 * | 4/2020 | Shioda | H01R 13/11 |

* cited by examiner

MOVABLE CONNECTOR

CROSS-REFERENCE TO RELATED APPLICATIONS

This application claims priority to Japanese Patent Application Nos. 2018-199154, filed on Oct. 23, 2018, and 2018-199155, filed on Oct. 23, 2018, the contents of which are hereby incorporated by reference.

TECHNICAL FIELD

The present disclosure relates to a movable connector.

BACKGROUND ART

Movable connectors such as the movable connector 20 of Patent Document 1 are known.

This movable connector 20 includes a stationary housing 21, a movable housing 22, elastically deformable terminals 23 that each have one end and another end press-fitted into and respectively retained at these two housings, and fixing fittings 24 that are press-fitted into and retained at the stationary housing 21. These elements include a protrusion 22d provided to each of the two ends of the movable housing 22, and a recess 21e corresponding to the protrusion 22d provided to each of the two ends of the stationary housing 21. The fixing fittings 24 are disposed on the stationary housing 21 so as to cover the recesses 21e.

In other words, the movable connector 20 includes the stationary housing 21 to be fixed to a substrate, the movable housing 22 that is capable of moving relative to the stationary housing 21, and restriction fittings (fixing fittings 24) that are integrated with the stationary housing 21. The restriction fittings (fixing fittings 24) are configured to abut parts of the movable housing 22 (the protrusions 22d) from a connector upward direction so as to restrain these parts (the protrusions 22d) in a predetermined region.

PATENT DOCUMENTS

Patent Document 1: Japanese Patent Application Laid-Open (JP-A) No. 2014-67706

SUMMARY OF INVENTION

Technical Problem

However, in the movable connector described above, the restriction fittings are press-fitted into and fixed to the stationary housing after the movable housing has been disposed with respect to the stationary housing. Were the restriction fittings to be fixed to the stationary housing before disposing the movable housing with respect to the stationary housing then assembly of the movable housing would no longer be possible.

An object of the present disclosure is to provide a movable connector with a novel structure capable of being manufactured by assembling a movable housing to a work-in-progress after integrating a restriction fitting to a stationary housing in advance.

Solution to Problem

A movable connector according to a first aspect is a movable connector including a stationary housing to be fixed to a substrate, a movable housing capable of moving relative to the stationary housing, and a restriction fitting that has been integrated with the stationary housing. The restriction fitting includes a counterpart engagement portion. The counterpart engagement portion is configured to abut an engagement portion that is part of the movable housing from a connector upward direction so as to enable the engagement portion to be restrained in a restraint space that is a predetermined region. The counterpart engagement portion forms a through-pass section to permit the engagement portion to pass into the restraint space from outside.

Note that the connector upward direction is a direction perpendicular to a surface of the substrate for the stationary housing to be fixed onto, and means the direction away from the substrate.

In this aspect the movable connector includes the stationary housing to be fixed to the substrate, the movable housing capable of moving relative to the stationary housing, and the restriction fitting that has been integrated with the stationary housing. The restriction fitting includes the counterpart engagement portion. The counterpart engagement portion is configured to abut the engagement portion that is part of the movable housing from the connector upward direction so as to enable the engagement portion to be restrained in the restraint space that is the predetermined region. Thus, in the completed state of the connector, the engagement portion is restrained in the restraint space by the counterpart engagement portion abutting the engagement portion from the connector upward direction and impeding further movement of the engagement portion in the connector upward direction.

Moreover, the counterpart engagement portion forms the through-pass section to permit the engagement portion to pass into the restraint space from outside. This thereby enables the movable housing to be assembled by the through-pass section, letting the engagement portion of the movable housing pass through the through-pass section so that the engagement portion enters into the restraint space from outside.

This enables the movable connector according to this aspect to be manufactured by assembling the movable housing to the work-in-progress after the restriction fitting has been integrated with the stationary housing in advance.

Integrating the stationary housing and the restriction fitting together is not limited to cases in which integration is achieved by performing insert molding. For example, the stationary housing and the restriction fitting may be integrated together by press-fitting the restriction fitting into the stationary housing.

Moreover, the "through-pass section to permit the engagement portion to pass into the restraint space from outside" may be a configuration in which passing is permitted by the restriction fitting deforming so that the through-pass section widens, may be a configuration in which passing is permitted by the counterpart engagement portion contacting the engagement portion to deform the engagement portion, or may be another embodiment.

A movable connector according to a second aspect is the first aspect, wherein the movable connector further includes a terminal including a stationary-side retained portion retained at the stationary housing, a movable-side retained portion retained at the movable housing, and an elastically deformable movable portion positioned between the stationary-side retained portion and the movable-side retained portion. Retention of the stationary-side retained portion with respect to the stationary housing is achieved by performing insert molding, and retention of the movable-side retained portion with respect to the movable housing is achieved by performing press-fitting.

In this aspect the movable connector further includes the terminal. The terminal includes the stationary-side retained portion retained at the stationary housing, the movable-side retained portion retained at the movable housing, and the elastically deformable movable portion positioned between the stationary-side retained portion and the movable-side retained portion.

Moreover, in this aspect the retention of the stationary-side retained portion with respect to the stationary housing is achieved by performing insert molding, and the retention of the movable-side retained portion with respect to the movable housing is achieved by performing press-fitting.

Namely, residual stress in the stationary housing is suppressed due to the retention of the terminal with respect to the stationary housing being achieved by performing insert molding, and also degrees of freedom in the shape of the movable housing are secured by the retention of the terminal with respect to the movable housing being achieved by performing press-fitting.

Thus this aspect enables residual stress in the stationary housing to be suppressed and also enables degrees of freedom in design of the movable housing to be secured in a movable connector including a stationary housing and a movable housing.

A movable connector according to a third aspect is the first or second aspect, wherein the stationary housing and the restriction fitting are integrated together by insert molding.

In this aspect the stationary housing and the restriction fitting are integrated together by insert molding. A process to press-fit the restriction fitting into the stationary housing is accordingly not needed. Moreover, residual stress in the stationary housing is suppressed due to the retention state of the restriction fitting in the stationary housing not being achieved by press-fitting.

The movable connector according to a fourth aspect is any one of the first to the third aspects, wherein the engagement portion includes an inclined portion to guide the engagement portion into the through-pass section.

In this aspect the engagement portion includes the inclined portion to guide the engagement portion into the through-pass section. This thereby enables the engagement portion to be guided to an appropriate position even when the engagement portion is somewhat out of position with respect to the through-pass section when the movable housing is being assembled.

Note that in an aspect in which the restriction fitting is deformable so as to widen the through-pass section (a sixth aspect, described later), the inclined portion of the engagement portion also acts to gradually increase the deformation amount of the restriction fitting by the inclined portion of the engagement portion being contacted against the counterpart engagement portion of the restriction fitting and being pushed in in the connector downward direction when the movable housing is being assembled. This enables damage to the restriction fitting to be suppressed from occurring.

Note that in an aspect in which the counterpart engagement portion functions as a blade to form a gouged groove in the engagement portion (a twelfth aspect, described later), the inclined portion of the engagement portion also acts to gradually increase the amount of digging in of the counterpart engagement portion into the engagement portion. This enables smooth assembly.

A movable connector according to a fifth aspect is any one of the first to the fourth aspects, wherein the counterpart engagement portion includes an inclined portion to guide the engagement portion into the through-pass section.

In this aspect the counterpart engagement portion includes the inclined portion to guide the engagement portion into the through-pass section. This thereby enables the engagement portion to be guided to an appropriate position even when the engagement portion is somewhat out of position with respect to the through-pass section when the movable housing is being assembled.

Note that in an aspect in which the restriction fitting is deformable so as to widen the through-pass section (a sixth aspect, described later), the inclined portion of the counterpart engagement portion also acts to gradually increase the deformation amount of the restriction fitting.

Note that in an aspect in which the counterpart engagement portion functions as a blade to form a gouged groove in the engagement portion (a twelfth aspect, described later), the inclined portion of the counterpart engagement portion also acts to gradually increase the amount of digging in of the counterpart engagement portion into the engagement portion.

First Exemplary Embodiment Correspondence

The movable connector according to a sixth aspect is any one of the first to the fifth aspects, wherein the restriction fitting deformable so as to widen the through-pass section.

In this aspect the restriction fitting deformable so as to widen the through-pass section. Namely, the through-pass section through which the engagement portion passes widens due to the restriction fitting deforming, permitting the engagement portion to enter into the restraint space from outside.

Note that in a first exemplary embodiment, described later, explanation is given of an example in which the restriction fitting is deformed by the engagement portion of the movable housing pressing against the counterpart engagement portion of the restriction fitting. However, the restriction fitting may be deformed using a tool etc. separate to the movable housing to deform the restriction fitting.

The movable connector according to a seventh aspect is the sixth aspect, wherein the restriction fitting includes an upward-extending portion extending toward the connector upward direction and having a plate thickness direction tilted by deformation of the restriction fitting, and a folded portion formed by folding a leading end side of the upward-extending portion back toward the through-pass section.

In this aspect the restriction fitting includes the upward-extending portion extending toward the connector upward direction and having a plate thickness direction tilted by deformation of the restriction fitting, and the folded portion formed by folding a leading end side of the upward-extending portion back toward the through-pass section. This accordingly enables sheet-end faces (cut end faces) of the restriction fitting to be suppressed from contacting the movable housing by causing the movable housing to contact the folded portion when assembling the movable housing. This accordingly enables suppression of damage to the movable housing.

A movable connector according to an eighth aspect is the seventh aspect, wherein the folded portion includes an inclined portion inclined toward the through-pass section on progression toward a connector downward direction.

In this aspect the folded portion includes the inclined portion inclined toward the through-pass section on progression toward the connector downward direction. This thereby enables the deformation amount of the restriction fitting to be gradually increased when the movable housing is brought into contact with the folded portion of the restriction fitting and the upward-extending portion is pushed wider.

Note that the "inclined portion" in the present aspect is equivalent to the "inclined portion" in the fifth aspect.

A movable connector according to a ninth aspect is the seventh or eighth aspect, wherein the plate thickness direction of the upward-extending portion is oriented in a connector width direction, and the engagement portion is configured so as not to abut the upward-extending portion from the connector width direction by a through hole being formed in the upward-extending portion.

In this aspect the plate thickness direction of the upward-extending portion is oriented in the connector width direction, and the engagement portion is configured so as not to abut the upward-extending portion from the connector width direction by the through hole being formed in the upward-extending portion. This thereby enables a large movable region to be secured in the connector width direction, without the movement range of the movable housing being limited by the upward-extending portion in the connector width direction.

A movable connector according to a tenth aspect is the ninth aspect, wherein a lower end of the folded portion and an upper edge of the through hole together configure an abutting portion that abuts the movable housing and limits a movement range of the movable housing in the connector upward direction.

In this aspect the lower end of the folded portion and the upper edge of the through hole together configure the abutting portion that abuts the movable housing and limits the movement range of the movable housing in the connector upward direction. Load input to the restriction fitting from the movable housing is thereby distributed, suppressing deformation and damage of the restriction fitting.

A movable connector according to an eleventh aspect is any one of the seventh to the tenth aspects, wherein the folded portion is configured including a vertical portion having a plate thickness direction oriented in a connector width direction and contacting a side wall of the movable housing.

In this aspect the folded portion is configured including the vertical portion having a plate thickness direction oriented in the connector width direction and contacting the side wall of the movable housing. The cut end faces of the deformed restriction fitting is thereby suppressed from damaging the movable housing.

Second Exemplary Embodiment Correspondence

A movable connector according to a twelfth aspect is any one of the first to the fifth aspects, wherein a gouged groove corresponding to a plate thickness of the counterpart engagement portion is formed in the engagement portion.

In this aspect the gouged groove corresponding to the plate thickness of the counterpart engagement portion is formed in the engagement portion of the movable housing. The movable connector according to this aspect is thereby able to be manufactured by assembling the movable housing to the work-in-progress by plastically deforming the engagement portion using the counterpart engagement portion of the restriction fitting.

Advantageous Effects

As described above, the present disclosure exhibits the excellent advantageous effect of enabling a movable connector to be manufactured by assembling a movable housing to a work-in-progress after a restriction fitting has been integrated with a stationary housing in advance.

DESCRIPTION OF EMBODIMENTS

First Exemplary Embodiment

Figure 1:
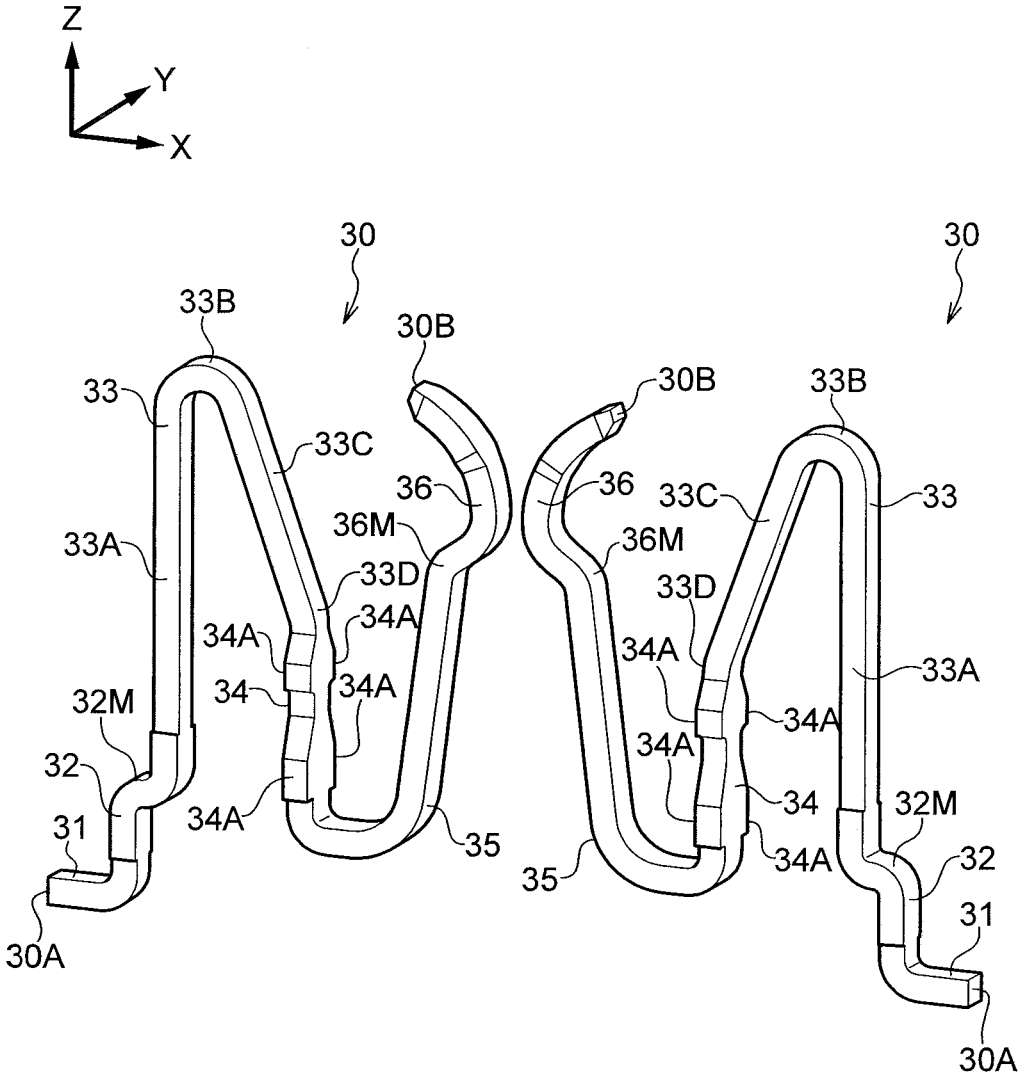
FIG. 1 is a perspective view illustrating terminals of a first exemplary embodiment.

Explanation follows regarding a first exemplary embodiment of the present disclosure, with reference to FIG. 1 to FIG. 14.

In the following explanation, the arrow X, the arrow Y, and the arrow Z in the drawings respectively indicate a connector forward direction, one side (a left side) in a connector width direction, and a connector upward direction. Unless specifically stated otherwise, reference to the front and rear, up and down, and width (left and right) refer to the front and rear in a connector front-rear direction, up and down in a connector up-down direction, and width (left and right) in the connector width direction (left-right direction).

Movable Connector Manufacturing Process

Explanation follows regarding a manufacturing process of a movable connector 100 (FIG. 7) according to the first exemplary embodiment.

First, terminals 30 (FIG. 1) and restriction fittings 40 (FIG. 2, FIG. 3) are made.

Figure 4:
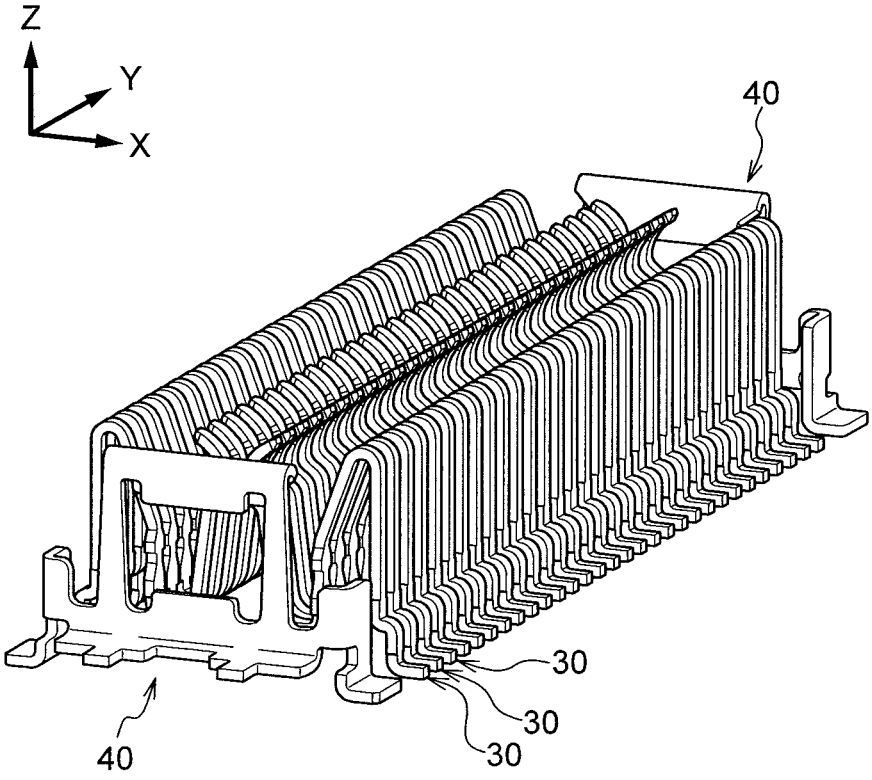
FIG. 4 is a perspective view illustrating a state in which terminals and restriction fittings have been arranged prior to performing insert molding in the first exemplary embodiment.
Figure 5:
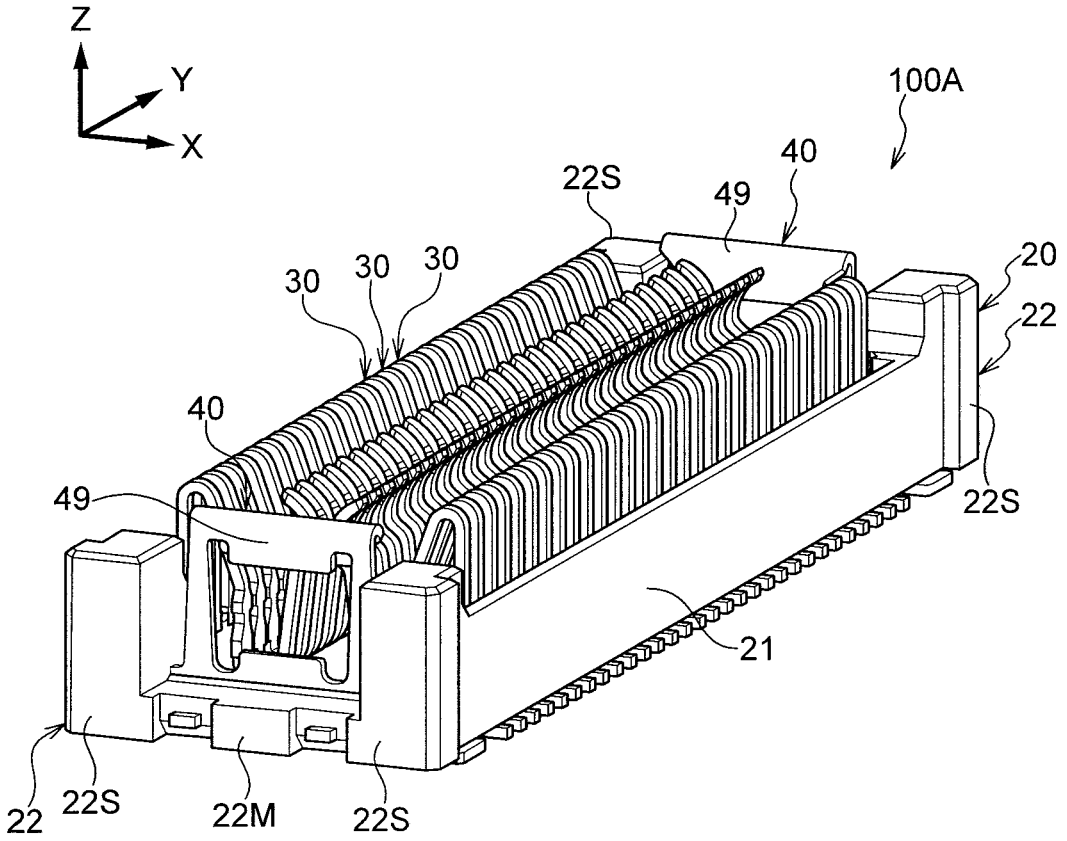
FIG. 5 is a perspective view illustrating a work-in-progress of the first exemplary embodiment.

Next, as illustrated in FIG. 4 to FIG. 5, a stationary housing 20 is molded into a single body with the terminals 30 and the restriction fittings 40 by insert molding (work-in-progress manufacturing process). The result is referred to as work-in-progress 100A.

Figure 6:
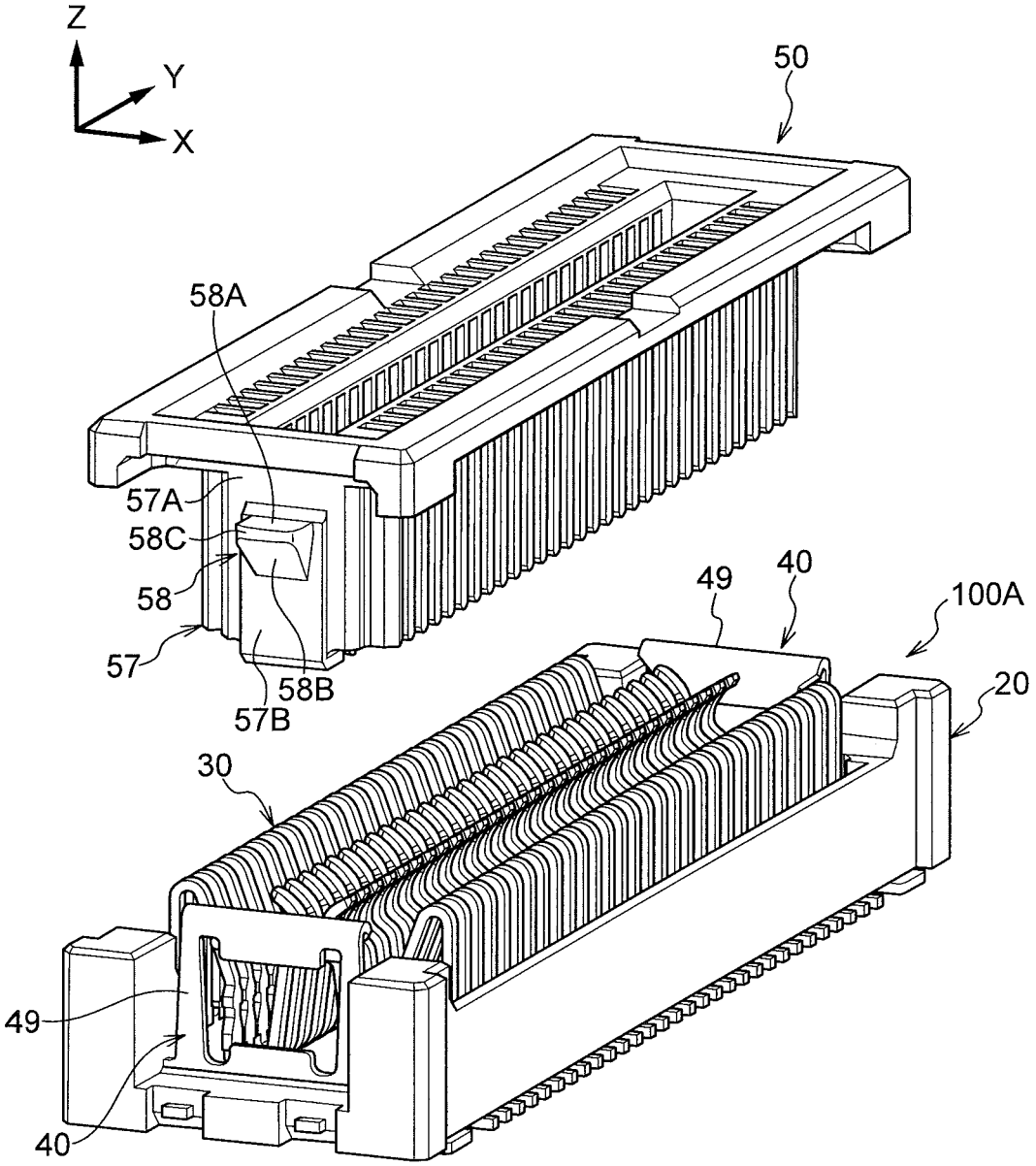
FIG. 6 is a perspective view illustrating a state prior to an assembly process in the first exemplary embodiment.
Figure 7:
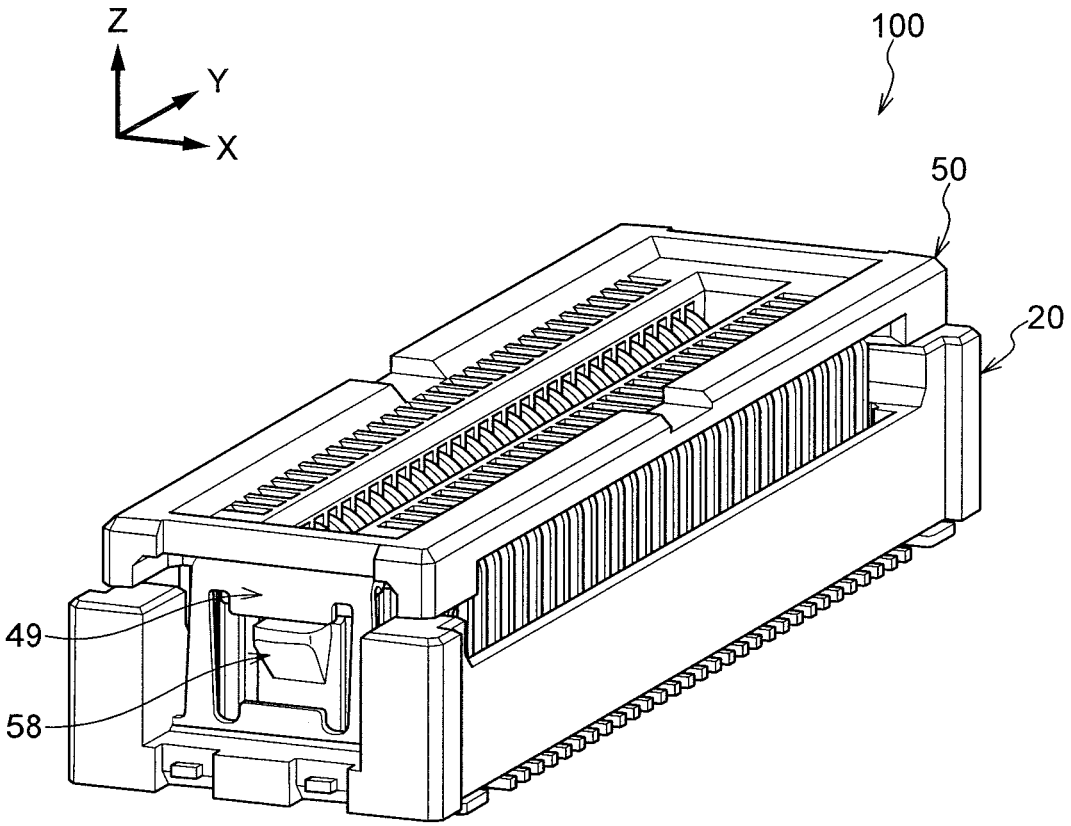
FIG. 7 is a perspective view illustrating a movable connector of the first exemplary embodiment.

Next, as illustrated in FIG. 6 and FIG. 7, a movable housing 50 is assembled to the work-in-progress 100A from above (assembly process). The movable connector 100 is completed thereby.

Detailed explanation follows regarding the assembly process, with reference to FIG. 11A to FIG. 11D.

Figure 11A:
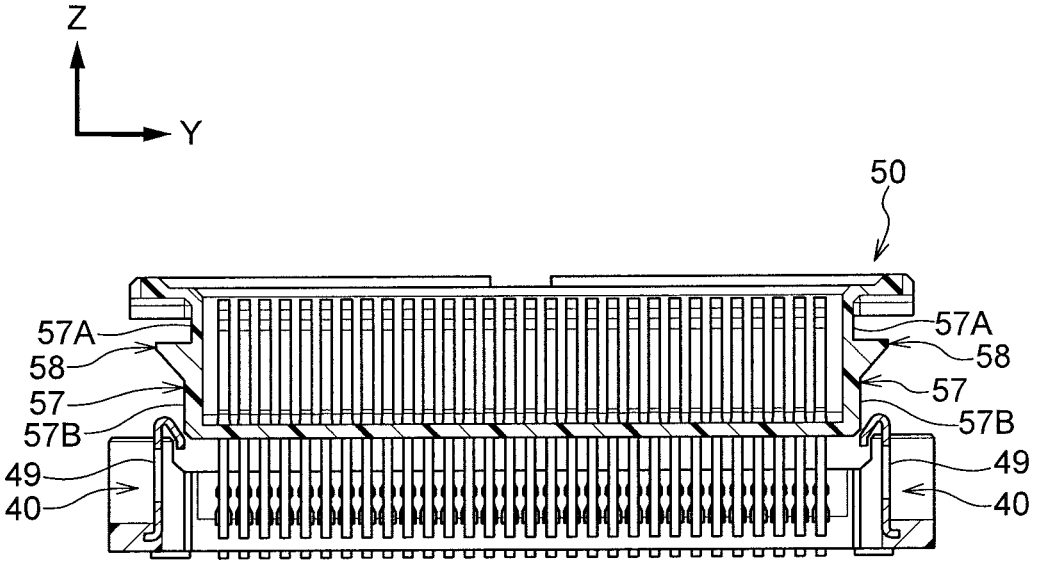
FIG. 11A is a (cross-sectional) side view illustrating a point in time that a movable housing contacts counterpart engagement portions in an assembly process.

During assembly of the movable housing 50 to the work-in-progress 100A from above, first, as illustrated in FIG. 11A, enlarged faces 57B of side walls 57 of the movable housing 50 are contacted with counterpart engagement portions 49 of the restriction fittings 40.

Figure 11B:
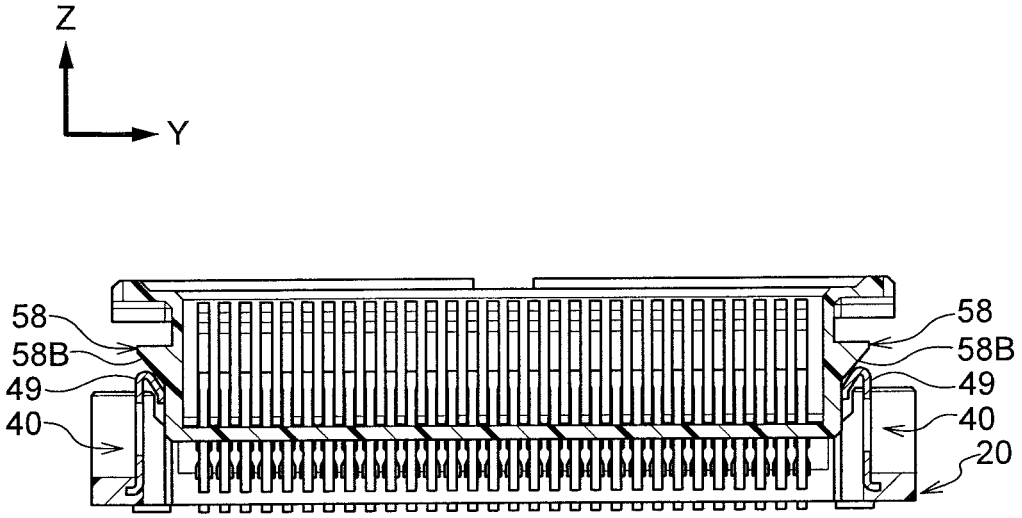
FIG. 11B is a (cross-sectional) side view illustrating a point in time that engagement portions of the movable housing contact the counterpart engagement portions in the assembly process.
Figure 11C:
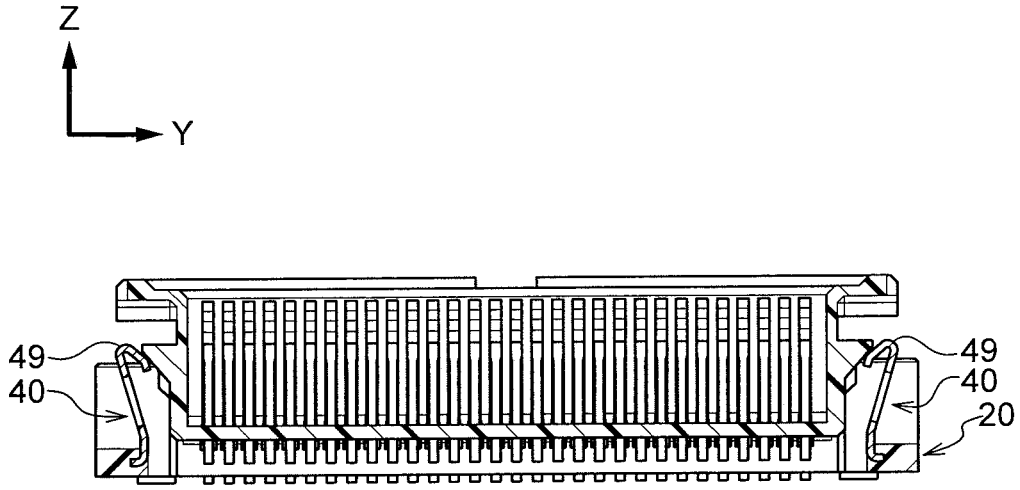
FIG. 11C is a (cross-sectional) side view illustrating a state in which restriction fittings have deformed to widen a through-pass section in the assembly process.
Figure 12:
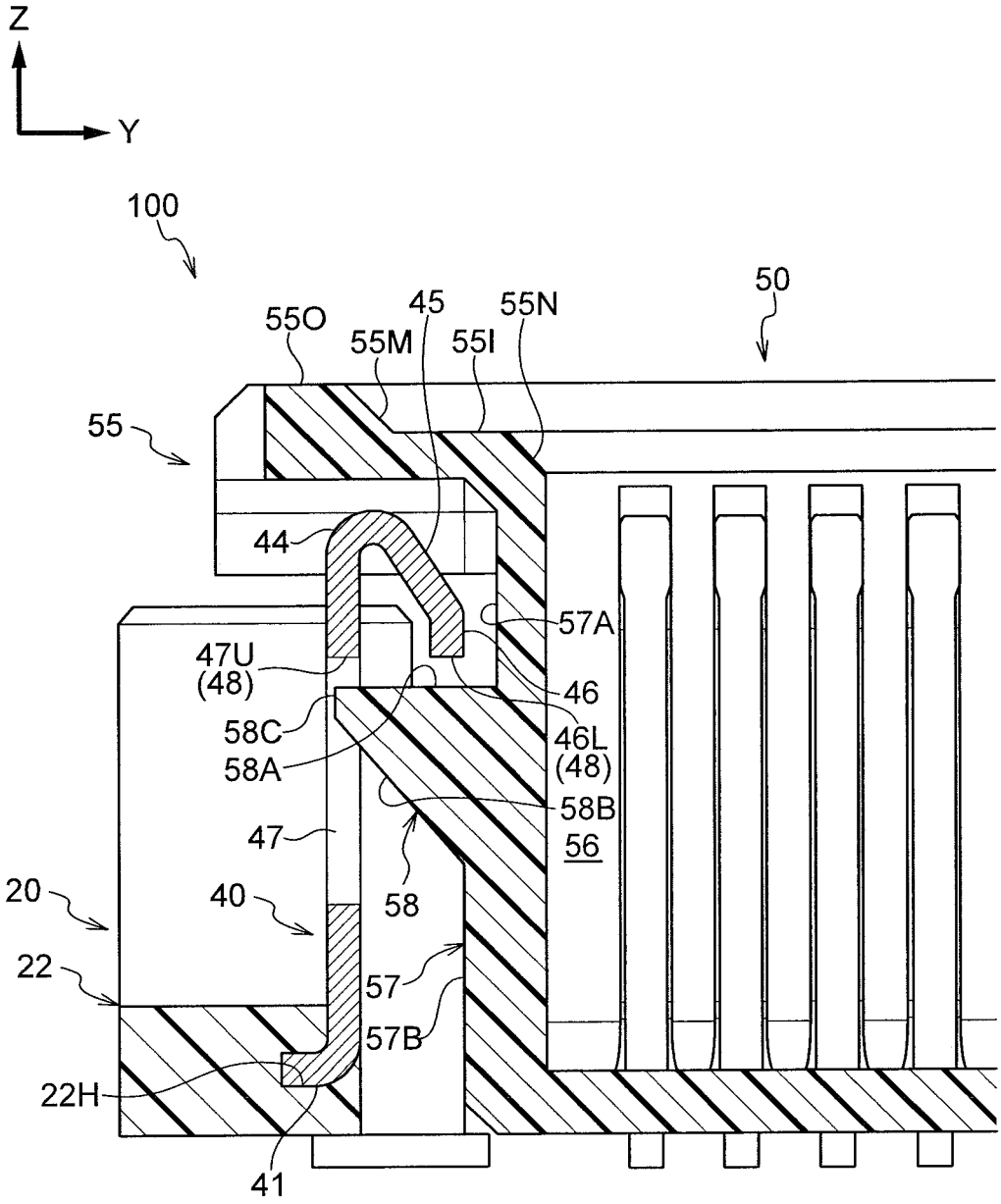
FIG. 12 is an enlarged view of part of FIG. 11D illustrating a state in which the assembly process has been completed.

Next, as illustrated in FIG. 11B, inclined portions 58B of engagement portions 58 are contacted with folded portions (bent portions 44, inclined portions 45, and vertical portions 46 in FIG. 12) of the counterpart engagement portions 49. The movable housing 50 is moved further downward from this state toward the state illustrated in FIG. 11C, and the deformation amount of the restriction fittings 40 is gradually increased.

Figure 11D:
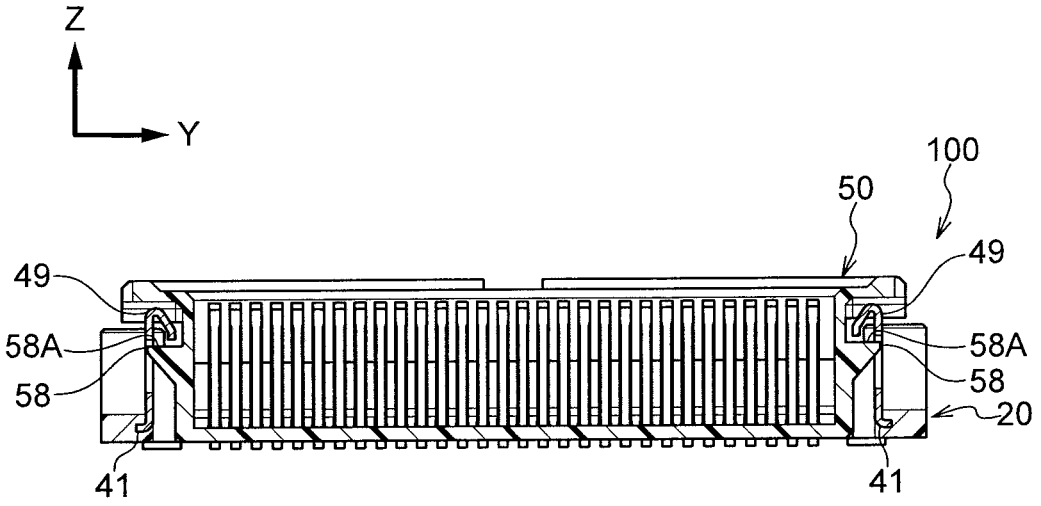
FIG. 11D is a (cross-sectional) side view illustrating a state in which the assembly process has been completed.

After the counterpart engagement portions 49 surpass the engagement portions 58, the deformed restriction fittings 40 return to their original shapes under elastic force (FIG. 11D). Note that in cases in which complete return to their original shape is not achieved under elastic force then shape recovery may be achieved by additional pressing.

Figure 8:
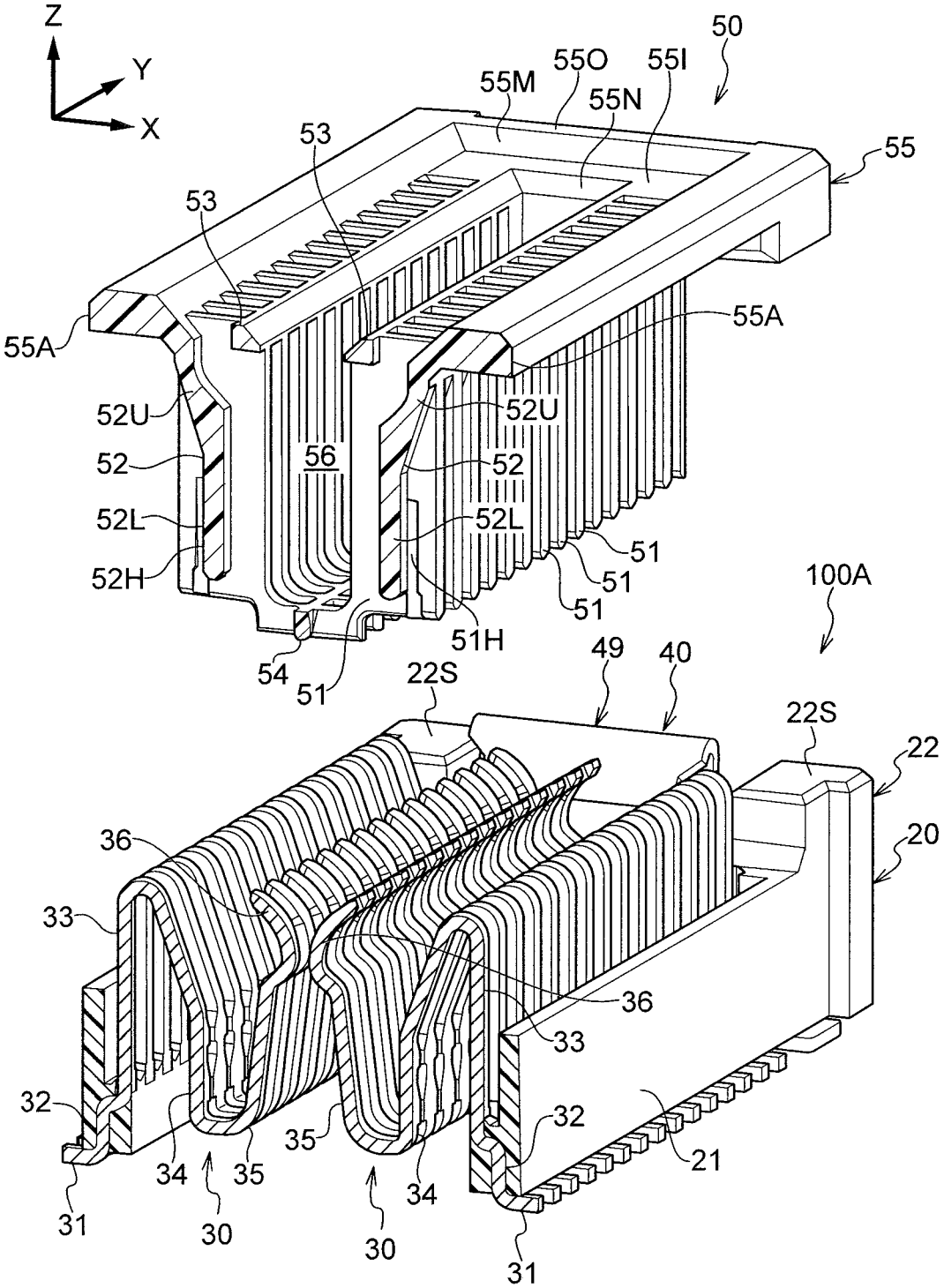
FIG. 8 is a cross-sectional perspective view corresponding to FIG. 6 and illustrating a state prior to an assembly process in the first exemplary embodiment.
Figure 9:
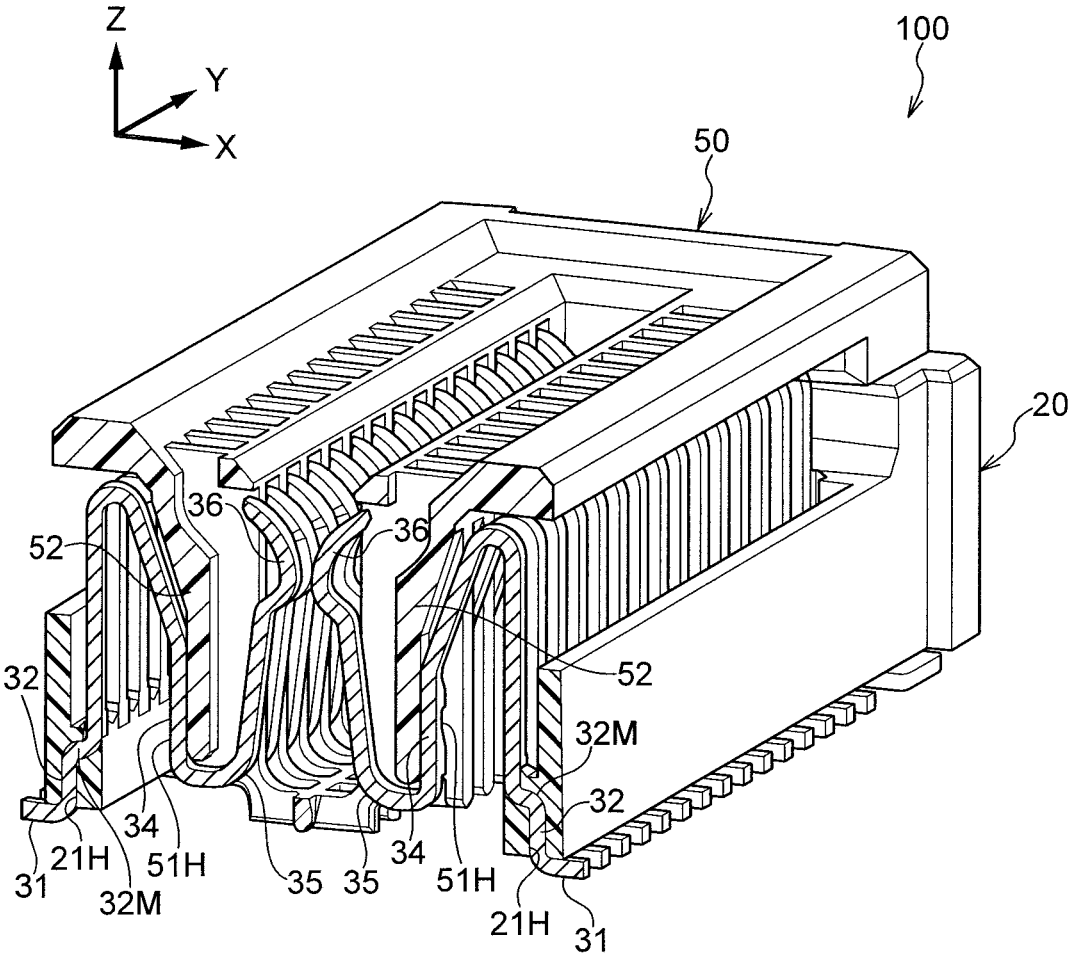
FIG. 9 is a cross-sectional perspective view illustrating a movable connector of the first exemplary embodiment.

In the assembly process as illustrated in FIG. 8 to FIG. 9, part (a movable-side retained portion 34) of each of the terminals 30 is press-fitted into and retained at the movable housing 50.

When in the completed state of the movable connector 100 as illustrated in FIG. 11D and FIG. 12, if the movable housing 50 moves in the connector upward direction, abutting portions 58A configuring upper faces of the respective engagement portions 58 abut abutting portions 48 (a lower end 46L of a folded portion and an upper edge 47U of a through hole 47 in FIG. 12) of the counterpart engagement portions 49, thereby limiting a movement range of the movable housing 50 in the connector upward direction.

Restraint Space RS, Through-Pass Section TH

When in the completed state of the movable connector 100, each of the engagement portions 58 of the movable housing 50 is in a state entered into a region (restraint space RS in FIG. 10) formed by the counterpart engagement portion 49 of the corresponding restriction fitting 40 and lying at the lower side of the counterpart engagement portion 49. The engagement portions 58 are restrained in the restraint space RS, thereby limiting a movement range of the movable housing 50 in the connector upward direction.

By contrast, in a state prior to the assembly process (the state in FIG. 11A), the engagement portions 58 of the movable housing 50 are not present at the lower side of the counterpart engagement portions 49 of the restriction fittings 40. The engagement portions 58 are therefore in a state outside of the restraint space RS.

Figure 10:
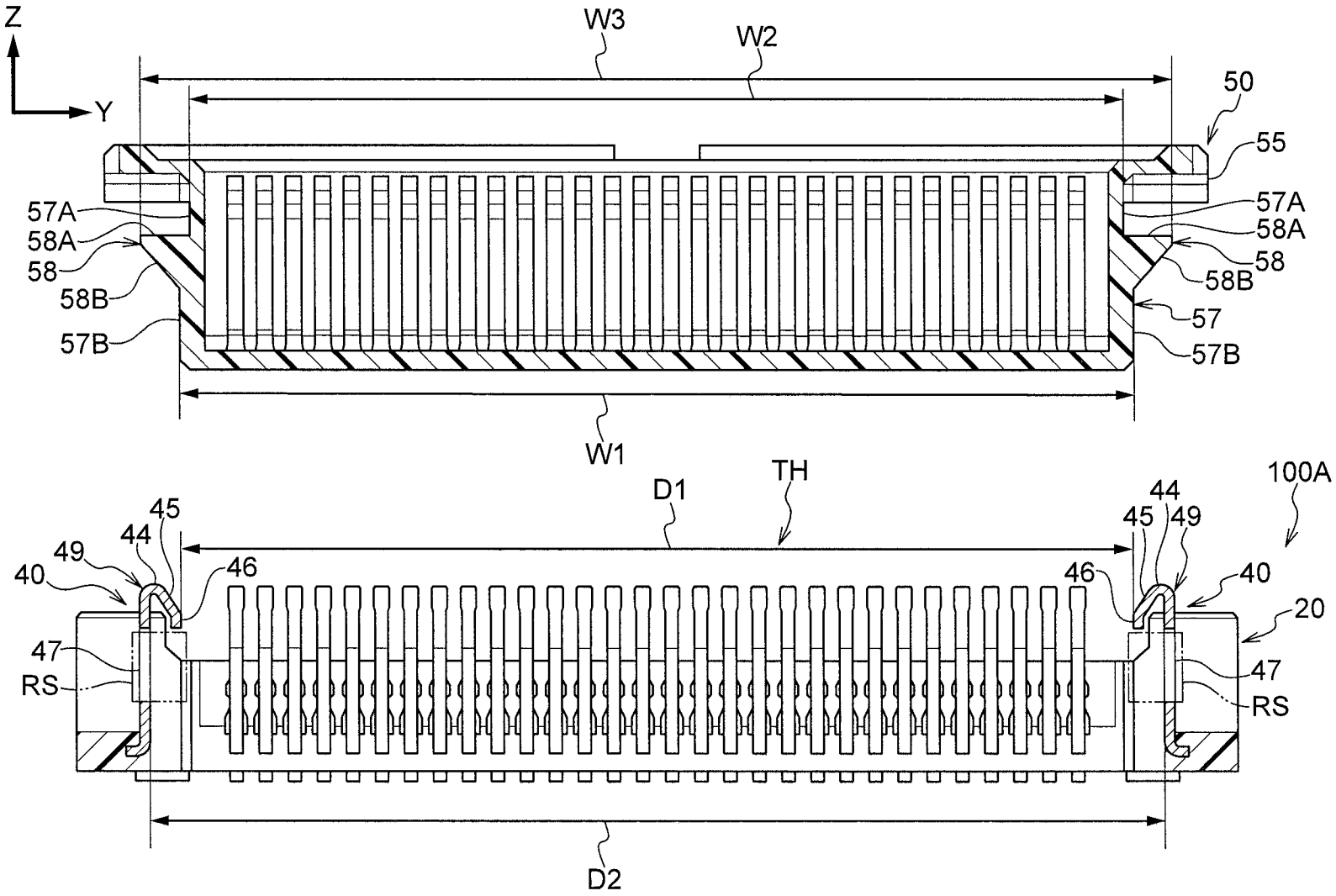
FIG. 10 is a (cross-sectional) side view illustrating a state prior to an assembly process in the first exemplary embodiment.

Accordingly, the assembly process (FIG. 11A to FIG. 11D) may be described as being a process of moving the engagement portions 58 into the restraint space RS from outside by passing the engagement portions 58 through between a pair of the counterpart engagement portions 49 (i.e. the through-pass section TH in FIG. 10).

In the present exemplary embodiment, in the assembly process the engagement portions 58 are passed through the through-pass section TH by deforming the restriction fittings 40 to widen the through-pass section TH (a spacing D1 between the pair of counterpart engagement portions 49, this being a spacing in the connector width direction in the present exemplary embodiment) (FIG. 11C). When in the completed state of the movable connector 100 as illustrated in FIG. 11D, the through-pass section TH that was widened is narrowed under the elastic force of the restriction fittings 40.

Terminals

A single movable connector 100 includes multiple terminals 30. As illustrated in FIG. 1, the multiple terminals 30 are disposed in pairs so as to oppose each other along the connector front-rear direction, and multiple of the terminal pairs 30, 30 are arrayed along the connector width direction.

The terminals 30 are formed by punching out from a sheet material and then bending.

Figure 13:
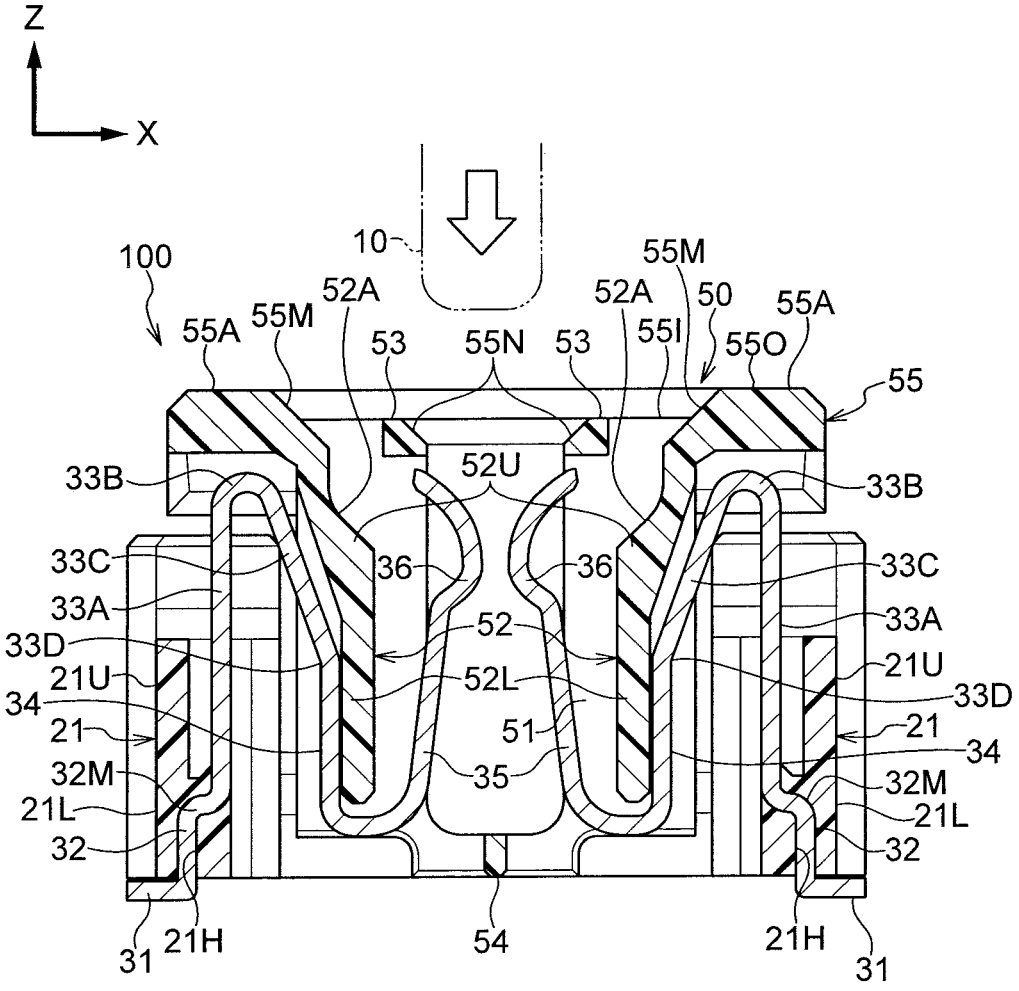
FIG. 13 is a cross-section (vertical cross-section sectioned along a connector width direction) illustrating a movable connector of the first exemplary embodiment.
Figure 14:
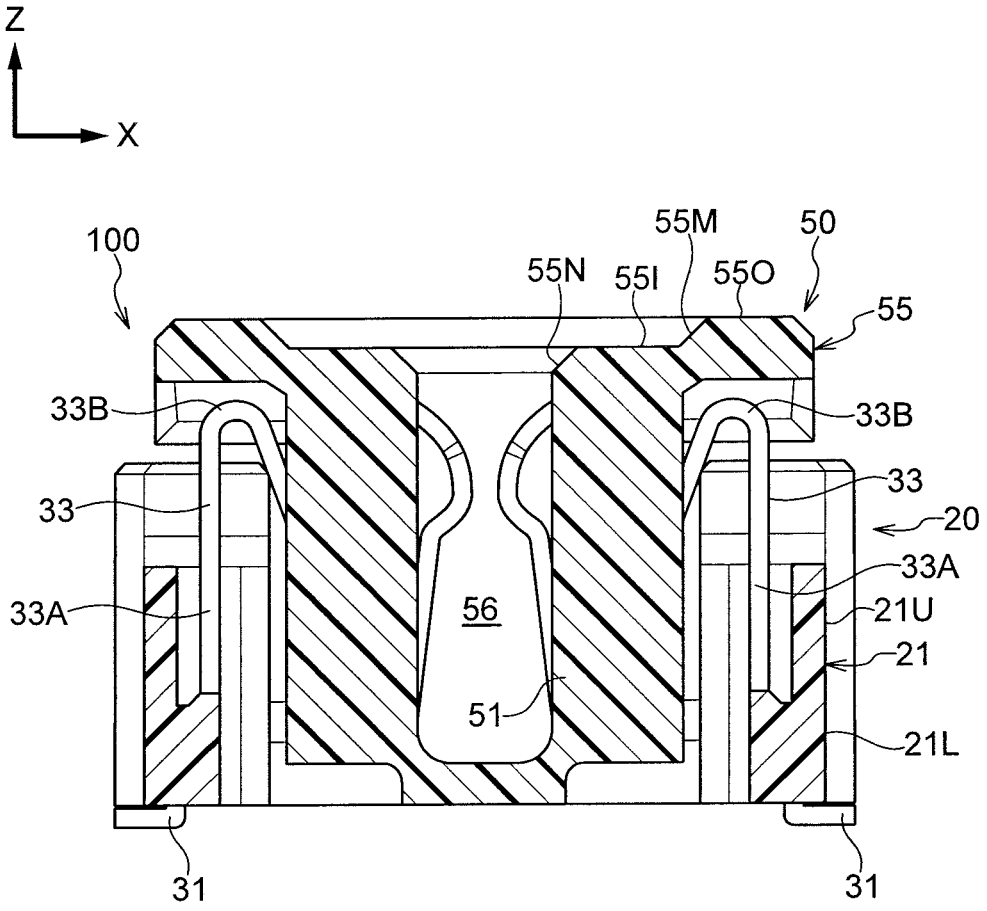
FIG. 14 is another cross-section (vertical cross-section sectioned along the connector width direction) illustrating a movable connector of the first exemplary embodiment.

As illustrated in FIG. 1 and FIG. 13, each of the terminals 30 includes a stationary-side retained portion 32 retained at the stationary housing 20, the movable-side retained portion 34 retained at the movable housing 50, and a movable portion 33 positioned between the stationary-side retained portion 32 and the movable-side retained portion 34.

As illustrated in FIG. 9 and FIG. 13, the stationary-side retained portion 32 is retained at the stationary housing 20 by being integrated with the stationary housing 20 by insert molding. The stationary-side retained portion 32 is configured including a bent portion 32M. Namely, the stationary-side retained portion 32 is retained at the stationary housing 20 in a state in which the bent portion 32M is embedded in the stationary housing 20.

The movable-side retained portion 34 is retained at the movable housing 50 by being press-fitted into the movable housing 50. As illustrated in FIG. 1, the movable-side retained portion 34 is formed with projections 34A to be retained at the movable housing 50 by being press-fitted therein. The projections 34A are shaped so as to enable the terminals 30 to be press-fitted upward into the movable housing 50.

The movable portion 33 is configured so as to readily undergo elastic deformation. Relative movement of the movable housing 50 with respect to the stationary housing 20 is accordingly permitted. As illustrated in FIG. 1, the movable portion 33 includes, in the following sequence from one end 30A to another end 30B, a first linear portion 33A extending upward from the stationary-side retained portion 32, a bent portion 33B bent so as to be upwardly convex, a second linear portion 33C extending obliquely downward and toward the connector front-rear direction inside, and a bent portion 33D between the second linear portion 33C and the movable-side retained portion 34.

Each of the terminals 30 further includes a contact portion 36 configured to contact a connection target 10 (FIG. 13) inserted into the connector from above. The contact portion 36 is positioned further toward the other end 30B side than the movable-side retained portion 34. The contact portion 36 has a curved profile so as to be convex on the connector front-rear direction inside, and the convex portion of the curved profile is configured to contact the connection target 10. The contact portion 36 includes a bent portion 36M between the contact portion 36 and an elastic portion 35, described later, with the bent portion 36M projecting the contact portion 36 toward the connector front-rear direction inside (the connection target 10 side).

Each of the terminals 30 includes the elastic portion 35 configured to undergo elastic deformation when the contact portion 36 contacts the connection target 10. The elastic portion 35 is positioned between the movable-side retained portion 34 and the contact portion 36. A spacing between each of the pairs of terminals 30, 30 that oppose each other in the connector front-rear direction is pushed wider by the connection target 10 being inserted therebetween, and the elastic portions 35 undergo elastic deformation. The contact portions 36 thereby make pressing contact with the connection target 10.

Restriction Fitting

There are two of the restriction fittings 40 provided to each movable connector 100. These two restriction fittings 40 have the same structure as each other.

Each of the restriction fittings 40 includes retained portions 41, 42 retained at the stationary housing 20. The restriction fittings 40 are integrated with the stationary housing 20 by insert molding, such that the restriction fittings 40 are retained at a state in which the retained portions 41, 42 are embedded in the stationary housing 20 as illustrated in FIG. 5 and FIG. 12.

Each of the restriction fittings 40 includes the counterpart engagement portion 49 to limit the movement range of the movable housing 50 in the upward direction with respect to the stationary housing 20 by abutting part of the movable housing 50 (the engagement portions 58) from the upper side.

Each of the counterpart engagement portions 49 includes, in the following sequence, an upward-extending portion 43 extending upward from the retained portion 41 side, a bent portion 44 formed at a leading end side of the upward-extending portion 43, an inclined portion 45 formed at a leading end side of the bent portion 44, and a vertical portion 46 formed at a leading end side of the inclined portion 45. The bent portion 44, the inclined portion 45, and the vertical portion 46 are formed by folding the leading end side of the upward-extending portion 43 over toward the connector width direction inside (the through-pass section TH side), and correspond to a "folded portion" of the present disclosure.

When pushing the movable housing 50 into the work-in-progress 100A during assembly, part of the movable housing 50 (the engagement portions 58) contacts the folded portion (i.e. the bent portion 44, inclined portion 45, and vertical portion 46) of the restriction fittings 40, such that a force pushing the pair of counterpart engagement portions 49 wider is applied to the restriction fittings 40. When this occurs, the restriction fittings 40 adopt a state deformed from the base end side of the upward-extending portions 43, such that the upward-extending portions 43 are tilted in a plate thickness direction (see FIG. 11C). When the movable housing 50 is pushed further downward therefrom, the engagement portions 58 of the movable housing 50 surpass leading ends (the lower ends 46L of the vertical portions 46) of the folded portions of the counterpart engagement portions 49. When this occurs, the restriction fittings 40 recover under elastic force such that the restriction fittings 40 return to their original shapes.

Note that in cases in which there is some residual plastic deformation of the restriction fittings 40 and the restriction fittings 40 do not return completely to their original shapes, then a separate force may be applied to the restriction fittings 40 to cause the restriction fittings 40 to recover to their original shapes.

The through hole 47 is formed through the upward-extending portion 43. There is accordingly a pair of arms 43A, 43A formed on either side of the through hole 47 in upward-extending portion 43 and arranged in a row along the connector front-rear direction.

As illustrated in FIG. 12, an upper edge 47U of the through hole 47 is formed at an up-down direction position aligned with the lower end 46L of the vertical portion 46 (lower end of the folded portion). The upper edges 47U of the through holes 47 and the lower ends 46L of the vertical portions 46 thus configure the abutting portions 48 that abut the engagement portions 58 of the movable housing 50.

Figure 2:
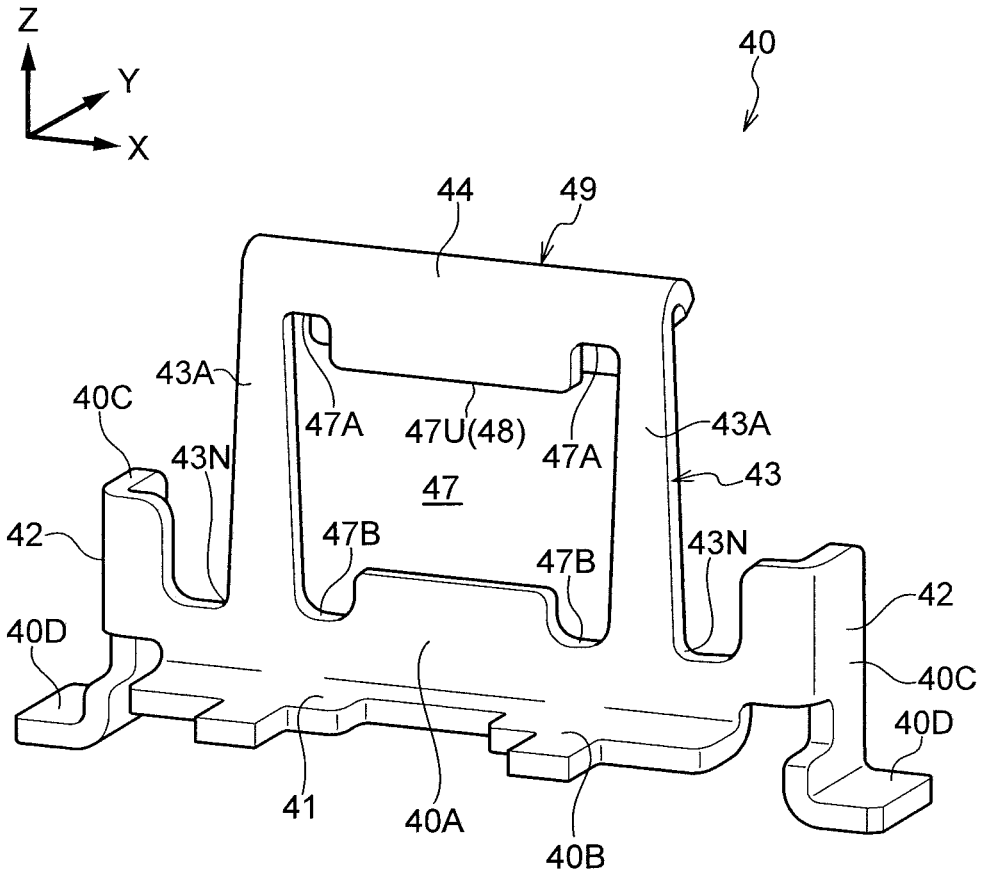
FIG. 2 is a perspective view illustrating a restriction fitting (on a connector right side) of the first exemplary embodiment.
Figure 3:
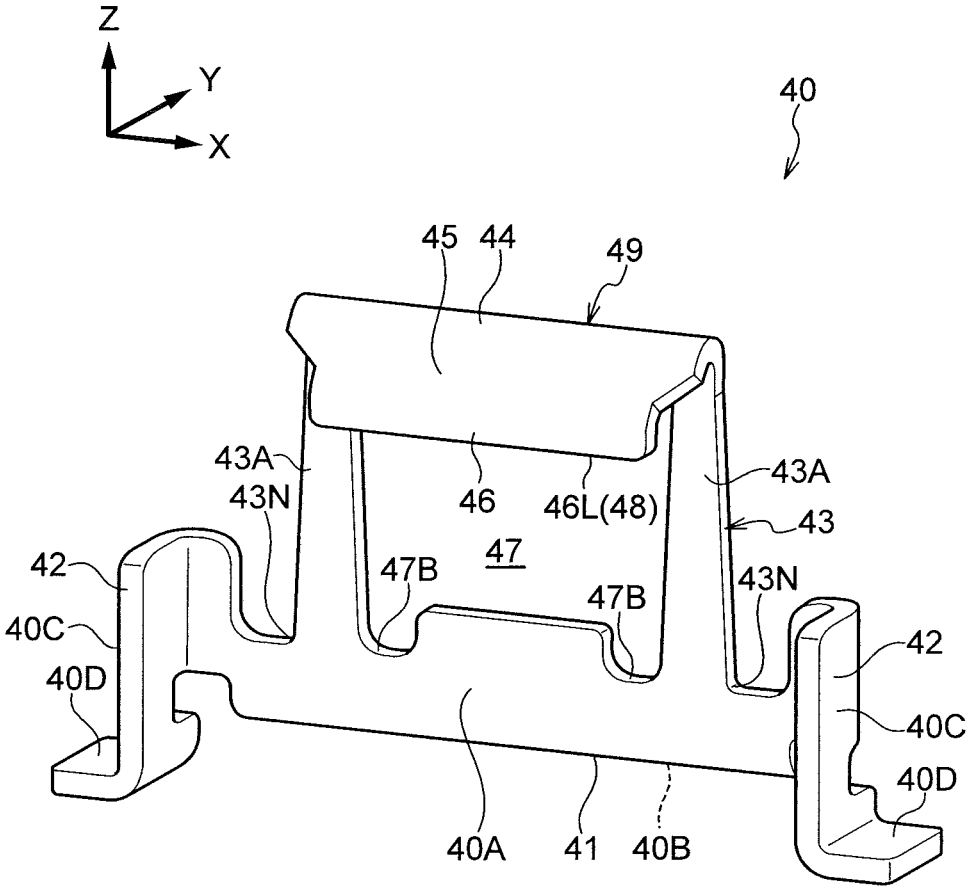
FIG. 3 is a perspective view illustrating a restriction fitting (on a connector left side) of the first exemplary embodiment.

The restriction fittings 40 are formed by punching out from a sheet material and then bending. As illustrated in FIG. 2 and FIG. 3, the majority of each restriction fitting 40 is configured by a width facing portion 40A having a plate thickness direction running in the connector width direction. An up-down facing portion 40B having a plate thickness direction running in the up-down direction is formed at a lower side of the width facing portion 40A on the other side of a bent portion. Front-rear facing portions 40C having a plate thickness direction running in the connector front-rear direction are formed at both front-rear direction sides of the width facing portion 40A on the other side of bent portions. Fixed portions 40D to be fixed to the substrate by soldering or the like are formed at the lower sides of the front-rear facing portions 40C on the other side of bent portions.

The whole of the bent portion between the width facing portion 40A and the up-down facing portion 40B ends up in an embedded state in the stationary housing 20 as part of the retained portion 41 described above. Moreover, the whole of the bent portions between the width facing portion 40A and the front-rear facing portions 40C end up in an embedded state in the stationary housing 20 as part of the retained portions 42 described above.

As illustrated in FIG. 2, the through hole 47 in the upward-extending portion 43 includes upward enlarged portions 47A, 47A. Portions on both width direction sides of the through hole 47 are enlarged upward at the upward enlarged portions 47A, 47A. A portion of the upper edge 47U of the through hole 47 between the upward enlarged portions 47A, 47A configures the abutting portion 48.

The through hole 47 in the upward extending portion 43 also includes downward enlarged portions 47B, 47B. Portions on both width direction sides of the through hole 47 are enlarged downward at the downward enlarged portions 47B, 47B. The length of the pair of arms 43A is thus extended downward to facilitate widening of the through-pass section TH by deformation of the restriction fittings 40.

On the restriction fittings 40, upper ends of the width facing portions 40A, the front-rear facing portions 40C, and the bent portions therebetween are positioned above base portions 43N of the upward-extending portion 43. The retained portions 42 of the restriction fittings 40 are thus enlarged upward with respect to the base portions 43N of the upward-extending portion 43. This secures a long up-down dimension of the upward-extending portion 43 as well as firm retention of the restriction fitting 40 with respect to the stationary housing 20.

Stationary Housing

As illustrated in FIG. 13, the stationary housing 20 includes terminal retention portions 21H for retaining the stationary-side retained portions 32 of the terminals 30. The terminal retention portions 21H are formed in front-rear walls 21, 21 of the stationary housing 20. Namely, the stationary-side retained portions 32 of the terminal 30 are retained at an embedded state in the front-rear walls 21, 21 of the movable connector 100.

A thickness of lower portions 21L of the front-rear walls 21, 21 of the stationary housing 20 is increased so as to project toward the connector front-rear direction inside with respect to upper portions 21U of the front-rear walls 21, 21. The stationary-side retained portions 32 of the terminals 30 are retained at the lower portions 21L of the front-rear walls 21, 21 of the stationary housing 20. Part of the first linear portions 33A of the movable portions 33 of the terminals 30 is thereby positioned at the connector front-rear direction inside of the upper portions 21U of the front-rear walls 21, 21 of the stationary housing 20.

As illustrated in FIG. 12, the stationary housing 20 includes fitting retention portions 22H for retaining the retained portions 41, 42 of the respective restriction fittings 40. The fitting retention portions 22H are formed in side walls 22, 22 formed on the two connector width direction sides of the stationary housing 20.

As illustrated in FIG. 5, each of the side walls 22 of the stationary housing 20 includes a pair of high wall portions 22S, 22S arranged along the connector front-rear direction, and a lower wall portion 22M connecting lower portions of the high wall portions 22S, 22S together. The retained portions 41 of the restriction fittings 40 are retained at the lower wall portions 22M, and the retained portions 42 of the restriction fittings 40 are retained at the high wall portions 22S. Spaces are formed between the front and rear high wall portions 22S, and the counterpart engagement portions 49 of the deformed restriction fittings 40 are able to enter therein.

Movable Housing

As illustrated in FIG. 8 and FIG. 9, the movable housing 50 includes terminal retention portions 51H configured to retain the movable-side retained portions 34 of the respective terminals 30. The terminals 30 are retained by the movable-side retained portions 34 of the terminals 30 being press-fitted into the corresponding terminal retention portions 51H.

As illustrated in FIG. 8, the movable housing 50 includes a receiving portion 56 to receive the connection target 10. The receiving portion 56 is a groove (space) opening toward an upper side of the movable housing 50, having a depth direction running in the connector downward direction, and extending along the connector width direction. As illustrated in FIG. 9, the contact portions 36 of the terminals 30 retained at the movable housing 50 are disposed inside the receiving portion 56, such that the connection target 10 contacts the contact portions 36 of the terminals 30 when the connection target 10 is inserted into the receiving portion 56.

The movable housing 50 includes plural partitioning walls 51 disposed between the respective terminals 30. The plural partitioning walls 51 are provided at uniform intervals along the connector width direction. Each of the terminals 30 is disposed between neighboring partitioning walls 51, 51.

A terminal press-fit groove 51H is formed in part of a wall face of each of the partitioning walls 51 so as to widen the spacing between the neighboring partitioning walls 51, 51. The terminal press-fit grooves 51H function as the terminal retention portions 51H described above.

The movable housing 50 further includes coupling portions 52 to couple the plural partitioning walls 51 together along the connector width direction. The coupling portions 52 increase the strength of the movable housing 50.

The coupling portions 52 extend along the up-down direction, and lower ends of the coupling portions 52 are positioned above lower ends of the partitioning walls 51, while upper ends of the coupling portions 52 are connected to front-and-rear portions 55A of an upper face 55 of the movable housing 50, described later.

More specifically, each of the coupling portions 52 is configured by a lower portion 52L extending along the up-down direction, and an upper portion 52U tilted toward the connector front-rear direction outside on progression upward. As illustrated in FIG. 13, the movable-side retained portions 34 of the terminals 30 are disposed so as to run along the lower portions 52L of the coupling portions 52, and the second linear portions 33C of the movable portions 33 of the terminals 30 are disposed so as to run along the upper portions 52U of the coupling portions 52. The lower portions 52L of the coupling portions 52 are disposed in relation to the movable-side retained portions 34 of the terminals 30 so as to be substantially contacting each other, and the upper portions 52U of the coupling portions 52 are disposed in relation to the second linear portions 33C of the movable portions 33 of the terminals 30 so as to be spaced apart therefrom so as to thereby enable displacement of the movable portions 33. Note that in the present disclosure, unless specifically stated otherwise, explanation regarding the placement of the terminals 30 assumes that the terminals 30 are in a free state.

Each of the terminals 30 extends from the connector front-rear direction outside of the corresponding coupling portion 52 to the connector front-rear direction inside of the coupling portions 52, such that part of the terminal 30 (the elastic portion 35) passes underneath the coupling portion 52. Each of the coupling portions 52 is thus disposed between the movable portions 33 and the movable-side retained portions 34 of the terminals 30, and the contact portions 36 of the terminals 30.

The lower ends of the coupling portions 52 and the terminals 30 positioned below the lower ends of the coupling portions 52A are spaced apart from each other in the up-down direction. The coupling portions 52 and the terminals 30 (the elastic portions 35 and the contact portions 36) positioned at the connector front-rear direction inside of the coupling portions 52 are also spaced apart from each other in the connector front-rear direction. This thereby permits deformation of the elastic portions 35 of the terminals 30.

A recess 52A indented toward the connector front-rear direction outside is formed in the upper portion 52U of each of the coupling portions 52. This secures a space into which leading ends of the contact portions 36 are able to enter when the elastic portions 35 are deformed.

The movable housing 50 further includes opening edge coupling portions 53 at upward opening edges of the receiving portion 56. The opening edge coupling portions 53 couple the plural partitioning walls 51 together in the connector width direction.

The movable housing 50 further includes a bottom coupling portion 54 at the bottom of the receiving portion 56 to couple the plural partitioning walls 51 together in the connector width direction. The bottom coupling portion 54 is configured with a structure (size and shape) to permit assembly to the movable housing 50 from below the terminals 30.

The movable housing 50 includes the upper face 55 configuring an upper face of the movable housing 50. The upper face 55 is formed in a rectangular shape with its length direction along the connector width direction in plan view. The upper face 55 includes the front-and-rear portions 55A extending along the connector width direction and configuring the two connector front-rear direction sides of the upper face 55. As illustrated in FIG. 13, the front-and-rear portions 55A protrude to the connector front-rear direction outsides so as to cover the movable portions 33 of the terminals 30 from above. Connector front-rear direction outside ends of the upper face 55 are thus positioned at the connector front-rear direction outsides of the movable portions 33 of the terminals 30 (the bent portions 33B and the first linear portions 33A thereof).

The opening edge coupling portions 53 configure part of the upper face 55. The opening edge coupling portions 53 and the front-and-rear portions 55A of the upper face 55 are provided so as to be separated from each other. There are accordingly, as illustrated in FIG. 8, plural spaces present between the plural partitioning walls 51, with the plural spaces opening onto portions of the upper face 55 between the opening edge coupling portions 53 and the front-and-rear portions 55A.

The upper face 55 may be understood to be configured including an outer rim 55O configuring an outer edge portion of the upper face 55, an inner rim 55I at the inner side of the outer rim 55O, and a receiving opening (opening of the receiving portion 56) inside the inner rim 55I. The outer rim 55O and the inner rim 55I are each flat surfaces lying in directions normal to the connector upward direction.

The outer rim 55O is formed higher than the inner rim 55I. In other words, the flat surface of the outer rim 55O is positioned further toward the connector up-down direction upper side than the flat surface of the inner rim 55I.

An inclined portion 55M is formed between the outer rim 55O and the inner rim 55I. The height of the inclined portion 55M decreases gradually on progression from the outer rim 55O to the inner rim 55I. The outer rim 55O, the inner rim 55I, and the inclined portion 55M are formed around substantially the entire periphery of the upper face 55. This enables the connection target 10 to be received smoothly into the receiving portion 56.

An inclined portion 55N is also formed at the boundary between the inner rim 55I and the receiving portion 56. The inclined portion 55N is formed to the opening edge coupling portions 53.

As illustrated in FIG. 12, the upper face 55 protrudes at the connector width direction outsides. Connector width direction outside ends of the upper face 55 are therefore positioned at the connector width direction outsides of the engagement portions 58, described later. Moreover, connector width direction outside ends of the inner rim 55I of the upper face 55 are positioned at the connector width direction outsides of the side walls 57 (general faces 57A and enlarged faces 57B thereof), described later.

The movable housing 50 includes the side walls 57 configuring walls on both connector width direction sides of the receiving portion 56 that is a groove (space) to receive the connection target 10. A pair of the side walls 57 is provided on the two connector width direction sides.

As illustrated in FIG. 12, the movable housing 50 includes the engagement portions 58 that limit a movement range of the movable housing 50 in the connector upward direction by abutting the restriction fittings 40 (at the counterpart engagement portions 49 thereof). The engagement portions 58 are formed on the connector width direction outside faces of the side walls 57 by being formed as projections projecting toward the connector width direction outsides.

Upper faces of the engagement portions 58 configure the abutting portions 58A abutting the counterpart engagement portions 49 and accordingly limiting the movement range. The abutting portions 58A are configured by flat surfaces having a normal direction oriented in the connector upward direction.

Each of the engagement portions 58 includes the inclined portion 58B that gradually decreases the dimension (a projection amount in the present exemplary embodiment) of the engagement portion 58 on progression in the connector downward direction. The inclined portion 58B is also configured by a flat surface.

Each of the engagement portions 58 further includes a vertical portion 58C positioned between the abutting portion 58A and the inclined portion 58B.

As illustrated in FIG. 6, a connector width direction outside face of each side wall 57 is configured including the general face 57A and the enlarged face 57B, which is positioned at the connector width direction outside of the general face 57A. As illustrated in FIG. 12, a portion on the upper side of each engagement portion 58 configures the general face 57A, and a portion at a lower side of each engagement portion 58 configures the enlarged face 57B. Accordingly, as illustrated in FIG. 10, a connector width direction dimension W1 at a portion of the movable housing 50 to the lower side of the engagement portions 58 is larger than a connector width direction dimension W2 of a portion of the movable housing 50 at an upper side of the engagement portions 58. Moreover, the dimension W1 is substantially the same as the spacing D1 between the pair of counterpart engagement portions 49 at the two connector width direction sides (i.e. is 98% to 105% thereof).

This accordingly facilitates positioning of the movable housing 50 with respect to the work-in-progress 100A in the connector width direction when assembling the movable housing 50 to the work-in-progress 100A. A movable region of the movable housing 50 is accordingly secured in the connector width direction between the pair of counterpart engagement portions 49 of the restriction fittings 40 when the shapes thereof have recovered after assembly of the movable housing 50 (FIG. 11D). Note that the vertical portions 46 of the counterpart engagement portions 49 of the restriction fittings 40 contact the general faces 57A of the side walls 57 of the movable housing 50 when the movable housing 50 moves in the connector width direction.

Moreover, as illustrated in FIG. 6, the enlarged face 57B is formed in a rectangular shaped region when the shape of the enlarged face 57B is viewed along the connector width direction. A width dimension (connector front-rear direction dimension) of the rectangular shaped region where the enlarged face 57B is formed is larger than this dimension on the engagement portion 58.

Operation and Advantageous Effects

Explanation follows regarding operation and advantageous effects of the present exemplary embodiment.

In the present exemplary embodiment, the movable connector 100 includes the stationary housing 20 to be fixed to the substrate, the movable housing 50 capable of moving relative to the stationary housing 20, and the restriction fittings 40 that have been integrated with the stationary housing 20. As illustrated in FIG. 10, the restriction fittings 40 include the counterpart engagement portions 49, and the counterpart engagement portions 49 are capable of restraining the engagement portions 58, which are part of the movable housing 50, in the restraint space RS, i.e. in a predetermined region, by abutting the engagement portions 58 from the connector upward direction.

Moreover, the counterpart engagement portions 49 form the through-pass section TH to permit the engagement portions 58 to pass into the restraint space RS from the outside. As illustrated in FIG. 11A to FIG. 11D, the movable housing 50 can be assembled by passing the engagement portions 58 of the movable housing 50 through the through-pass section TH to move the engagement portions 58 into the restraint space RS from the outside.

As described above, the movable connector 100 can be manufactured by assembling the movable housing 50 to the work-in-progress 100A after the restriction fittings 40 have been integrated with the stationary housing 20 in advance.

Moreover, in the present exemplary embodiment, the movable connector 100 includes the stationary housing 20 to be fixed to the substrate, the movable housing 50 configured so as to be capable of moving relative to the stationary housing 20, and the terminals 30. Each of the terminals 30 includes the stationary-side retained portion 32 retained at the stationary housing 20, the movable-side retained portion 34 retained at the movable housing 50, and the elastically deformable movable portion 33 positioned between the stationary-side retained portion 32 and the movable-side retained portion 34.

The retention of the stationary-side retained portion 32 in the stationary housing 20 is achieved by performing insert molding, and the retention of the movable-side retained portion 34 in the movable housing 50 is achieved by performing press-fitting.

Namely, residual stress in the stationary housing 20 is suppressed due to the terminals 30 being retained on the movable housing 50 by performing insert molding, and degrees of freedom in the shape of the movable housing 50 are secured due to the retention of the terminal 30 on the stationary housing 20 being achieved by performing press-fitting.

Accordingly, in the present exemplary embodiment the movable connector 100 including the stationary housing 20 and the movable housing 50 is capable of suppressing residual stress in the stationary housing 20 while also being able to secure degrees of freedom for design of the movable housing 50.

In the present exemplary embodiment, the stationary housing 20 and the restriction fittings 40 are integrated together by insert molding. A process to press-fit the restriction fittings 40 into the stationary housing 20 is therefore not required.

In the present exemplary embodiment, the restriction fittings 40 are deformable so as to widen the through-pass section TH (the space between the pair of counterpart engagement portions 49 in FIG. 10) (FIG. 11C). Accordingly, the engagement portions 58 are able to enter the restraint space RS due to the restriction fittings 40 being deformed so as to widen the through-pass section TH when the movable housing 50 is being assembled to the work-in-progress 100A.

In the present exemplary embodiment, each of the engagement portions 58 includes the inclined portion 58B to guide the engagement portion 58 into the through-pass section TH. Accordingly, the engagement portions 58 can still be guided to an appropriate position even if the engagement portions 58 are somewhat out of position in the connector width direction when assembling the movable housing 50. In particular, the inclined portions 58B of the engagement portions 58 in the present exemplary embodiment can be contacted with the counterpart engagement portions 49 of the restriction fittings 40 when the movable housing 50 is being assembled, so as to act to gradually increase the deformation amount of the restriction fittings 40 by the inclined portions 58B being pushed in along the connector downward direction. This enables damage to the restriction fittings 40 to be suppressed.

Each of the restriction fittings 40 in the present exemplary embodiment includes the upward-extending portion 43 extending in the connector upward direction from the retained portion 41 side and the folded portion (i.e. the bent portion 44, the inclined portion 45, and the vertical portion 46 in the present exemplary embodiment) formed by folding the leading end side of the upward-extending portion 43 back toward the through-pass section TH (toward the connector width direction inside). This accordingly means that sheet-end faces (cut end faces) of the restriction fittings 40 are suppressed from contacting the movable housing 50 when assembling the movable housing 50.

In the present exemplary embodiment, the engagement portions 58 are configured so as not to abut the upward-extending portions 43 from the connector width direction by forming the through holes 47 in the upward-extending portions 43. The movement range of the movable housing 50 in the connector width direction is therefore not limited by the upward-extending portions 43, enabling a large movable region of the movable housing 50 to be secured in the connector width direction.

Furthermore, the lower ends 46L of the folded portions of the counterpart engagement portions 49 configure the abutting portions 48 that abut the movable housing 50 and limit the movement range of the movable housing 50 in the connector upward direction, and in addition the upper edges 47U of the through holes 47 also configure the abutting portions 48 that abut the movable housing 50 and limit the movement range of the movable housing 50 in the connector upward direction. Load input to the restriction fittings 40 from the movable housing 50 is distributed thereby, suppressing deformation or damage to the restriction fittings 40.

Another point is that, as illustrated in FIG. 10, a connector width direction dimension W3 of the engagement portions 58 of the movable housing 50 in the present exemplary embodiment is larger than the spacing D2 between the pair of upward-extending portions 43. This enables a large engagement amount (the dimension of overlap between the engagement portions 58 and the counterpart engagement portions 49 in plan view) to be realized between the engagement portions 58 and the counterpart engagement portions 49.

In the present exemplary embodiment, the folded portions of the counterpart engagement portions 49 are each configured including the vertical portion 46 having a plate thickness direction aligned with the connector width direction and contacting the side wall 57 of the movable housing 50. The cut end faces of the restriction fittings 40 are thus suppressed from damaging the movable housing 50.

Second Exemplary Embodiment

Explanation follows regarding a second exemplary embodiment of the present disclosure, with reference to FIG. 15 to FIG. 29.

Movable Connector Manufacturing Process

Explanation follows regarding a process to manufacture a movable connector 200 (FIG. 21) according to the second exemplary embodiment.

First, terminals 70 (FIG. 15) and restriction fittings 80 (FIG. 16, FIG. 17) are manufactured.

Figure 18:
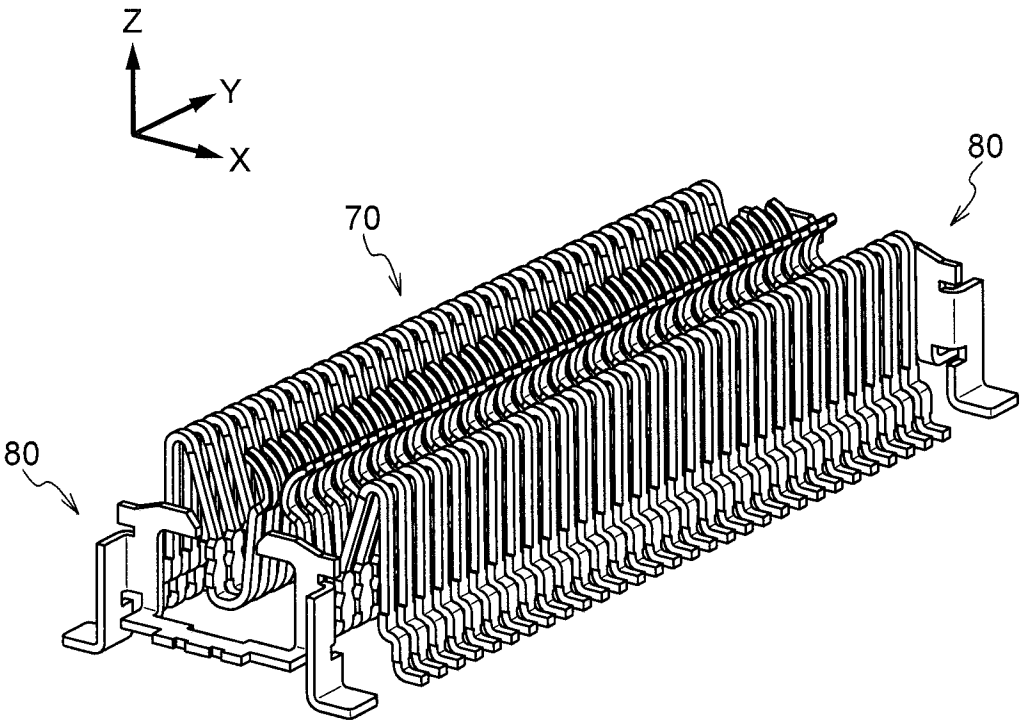
FIG. 18 is a perspective view illustrating a state in which terminals and restriction fittings have been arranged prior to performing insert molding in the second exemplary embodiment.
Figure 19:
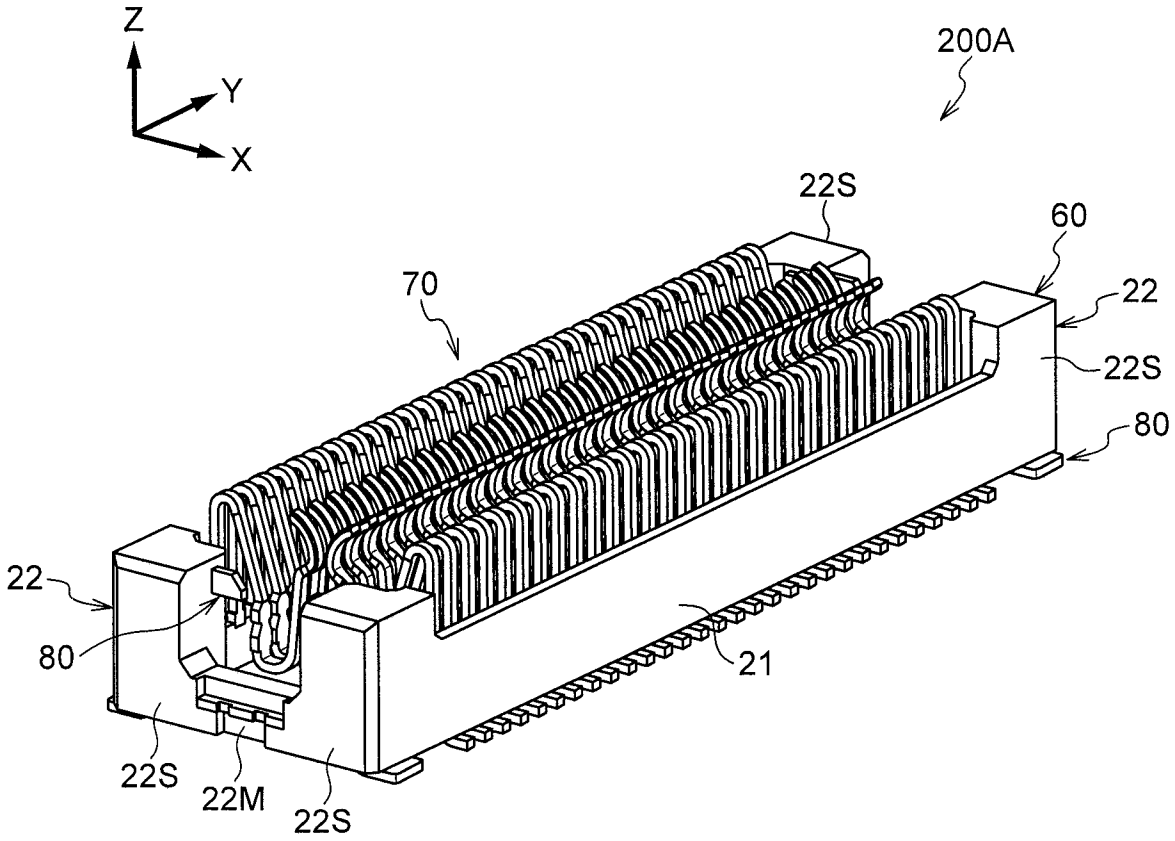
FIG. 19 is a perspective view illustrating a work-in-progress of the second exemplary embodiment.

Next, as illustrated in FIG. 18 and FIG. 19, a stationary housing 60 is molded into a single body with the terminals 70 and the restriction fittings 80 by insert molding (work-in-progress manufacturing process). The resultant is referred to as work-in-progress 200A.

Figure 20:
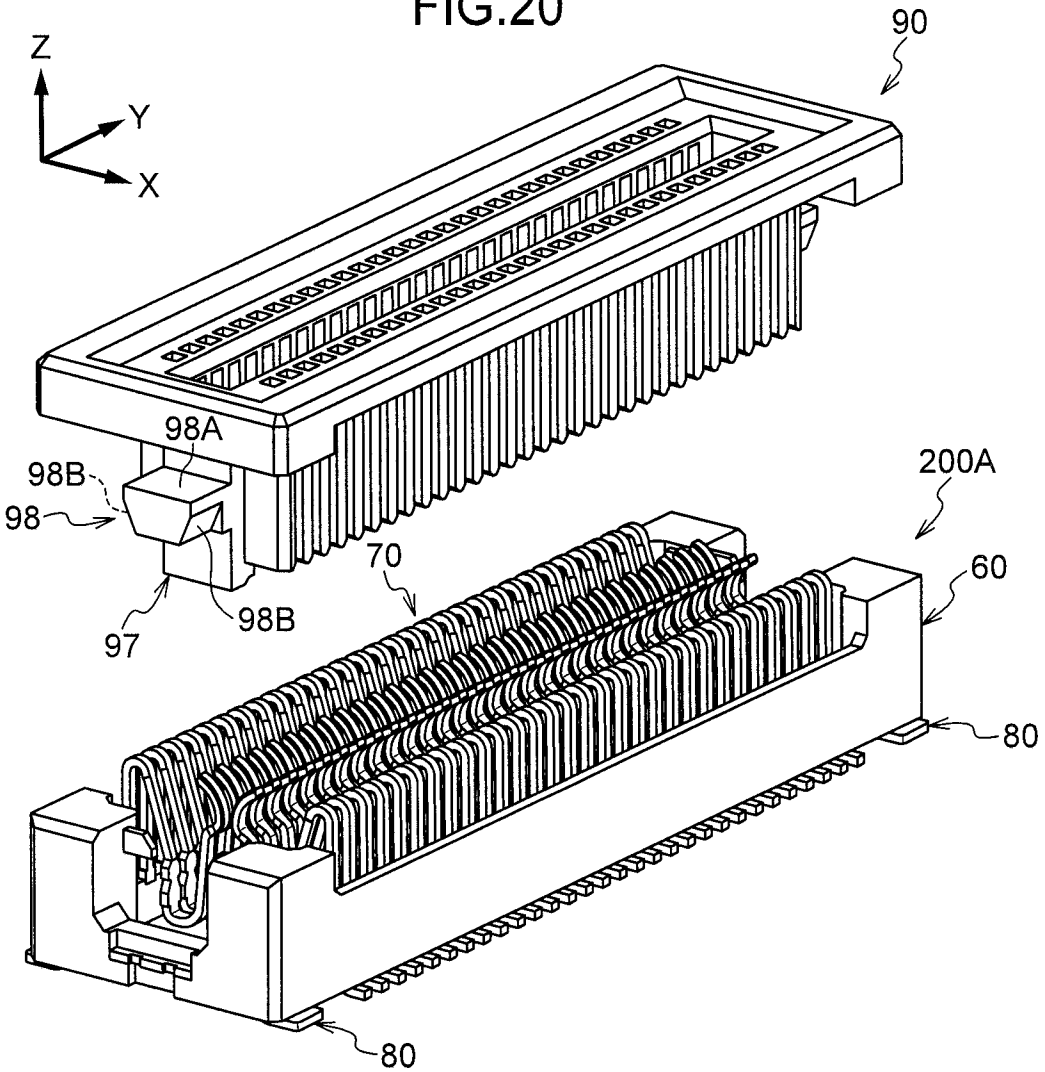
FIG. 20 is a perspective view illustrating a state prior to an assembly process in the second exemplary embodiment.
Figure 21:
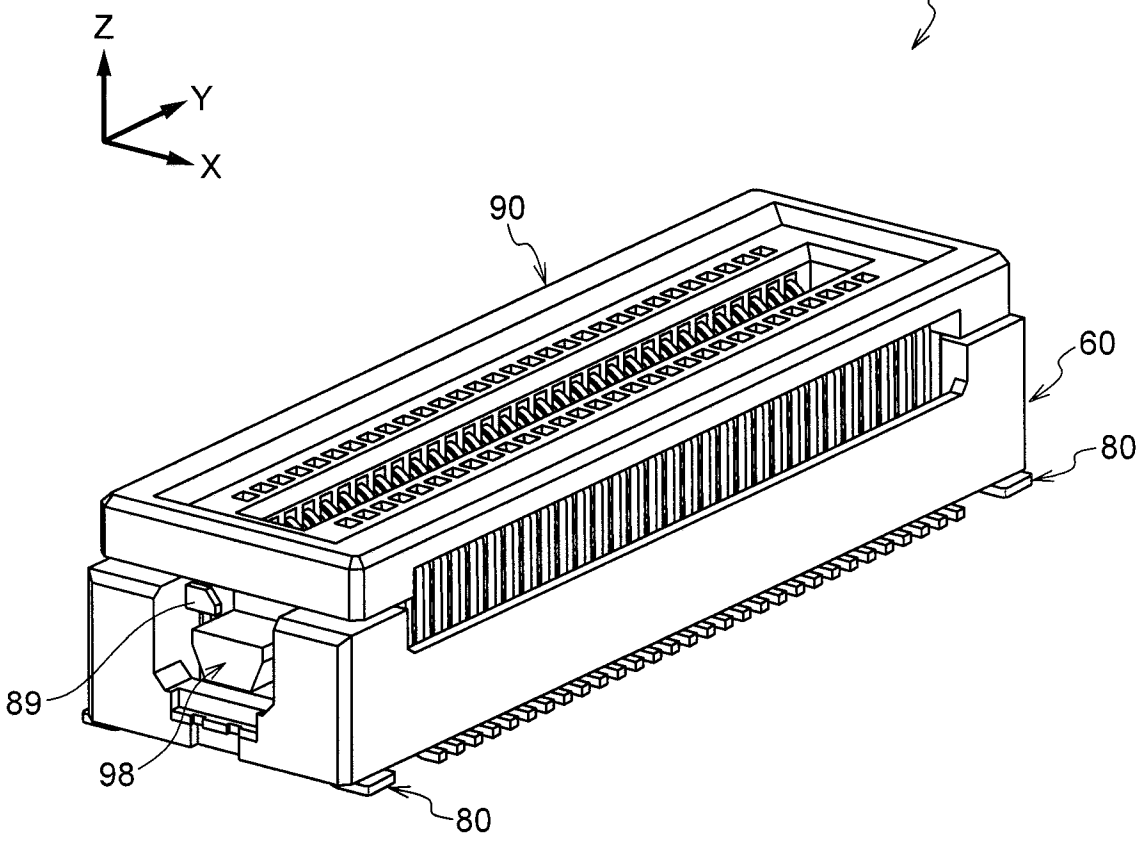
FIG. 21 is a perspective view illustrating a movable connector of the second exemplary embodiment.
Figure 22:
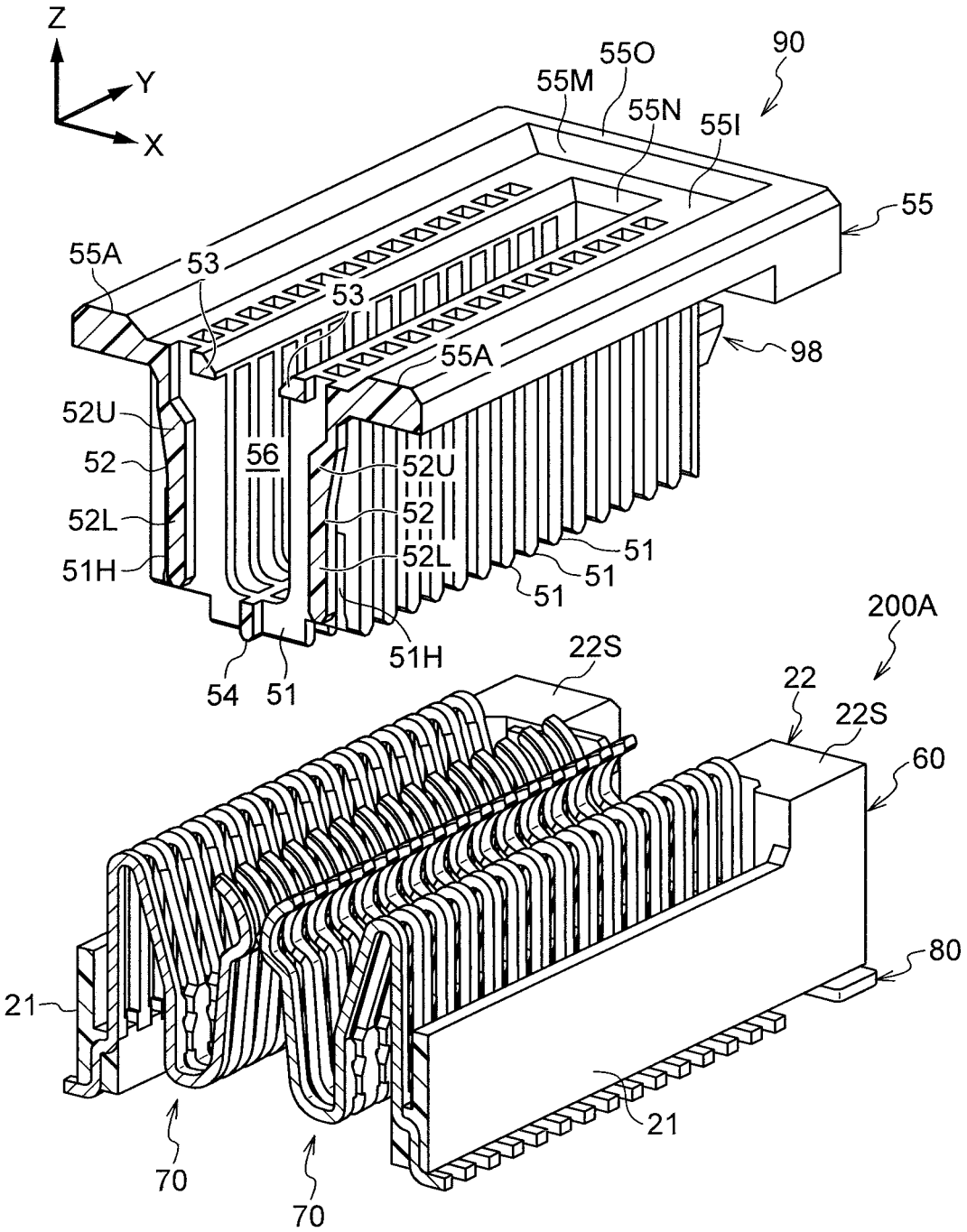
FIG. 22 is a cross-sectional perspective view corresponding to FIG. 20 and illustrating a state prior to an assembly process in the second exemplary embodiment.
Figure 23:
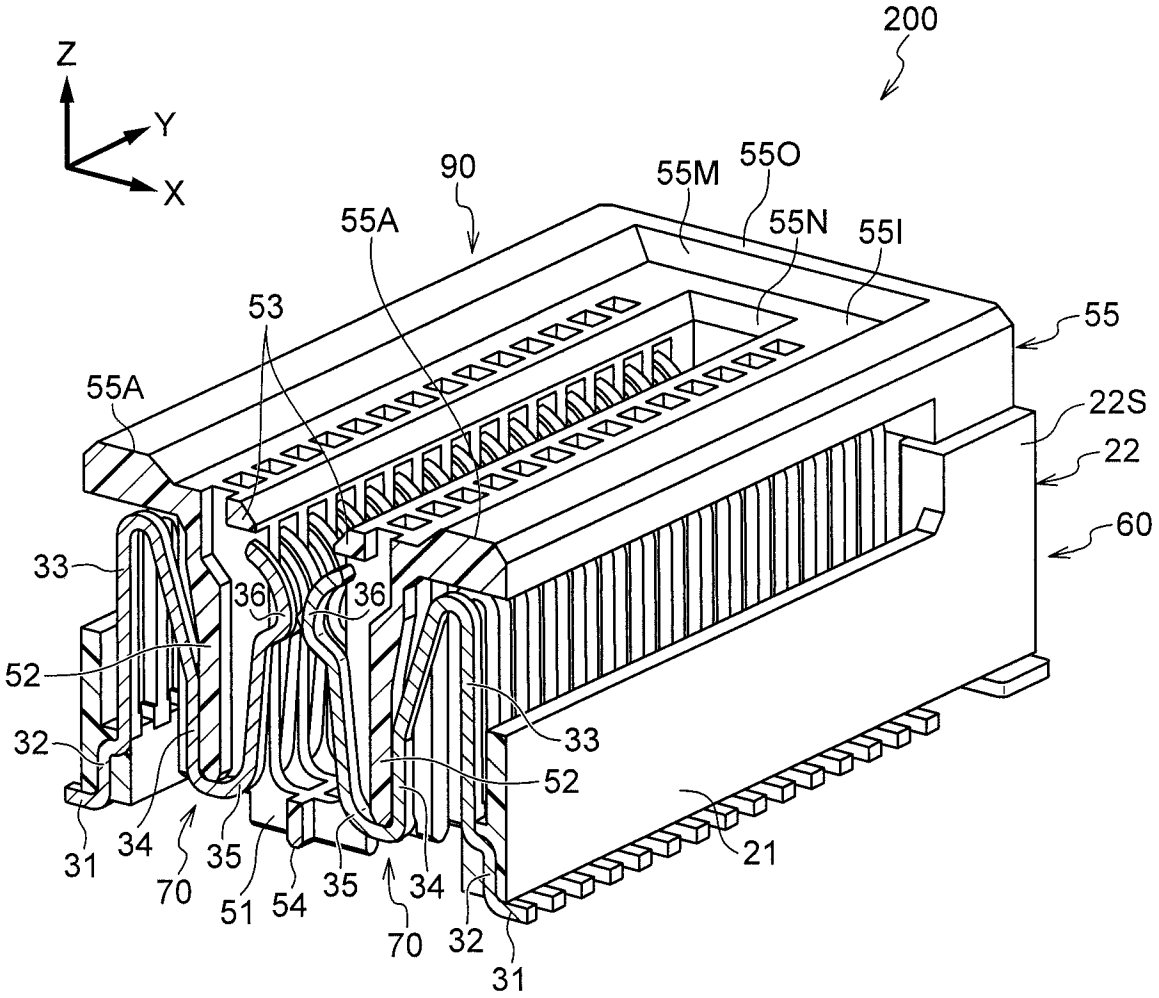
FIG. 23 is a cross-sectional perspective view illustrating a movable connector of the second exemplary embodiment.

Next, as illustrated in FIG. 20 and FIG. 21, a movable housing 90 is assembled to the work-in-progress 200A from above (assembly process).

Figure 24A:
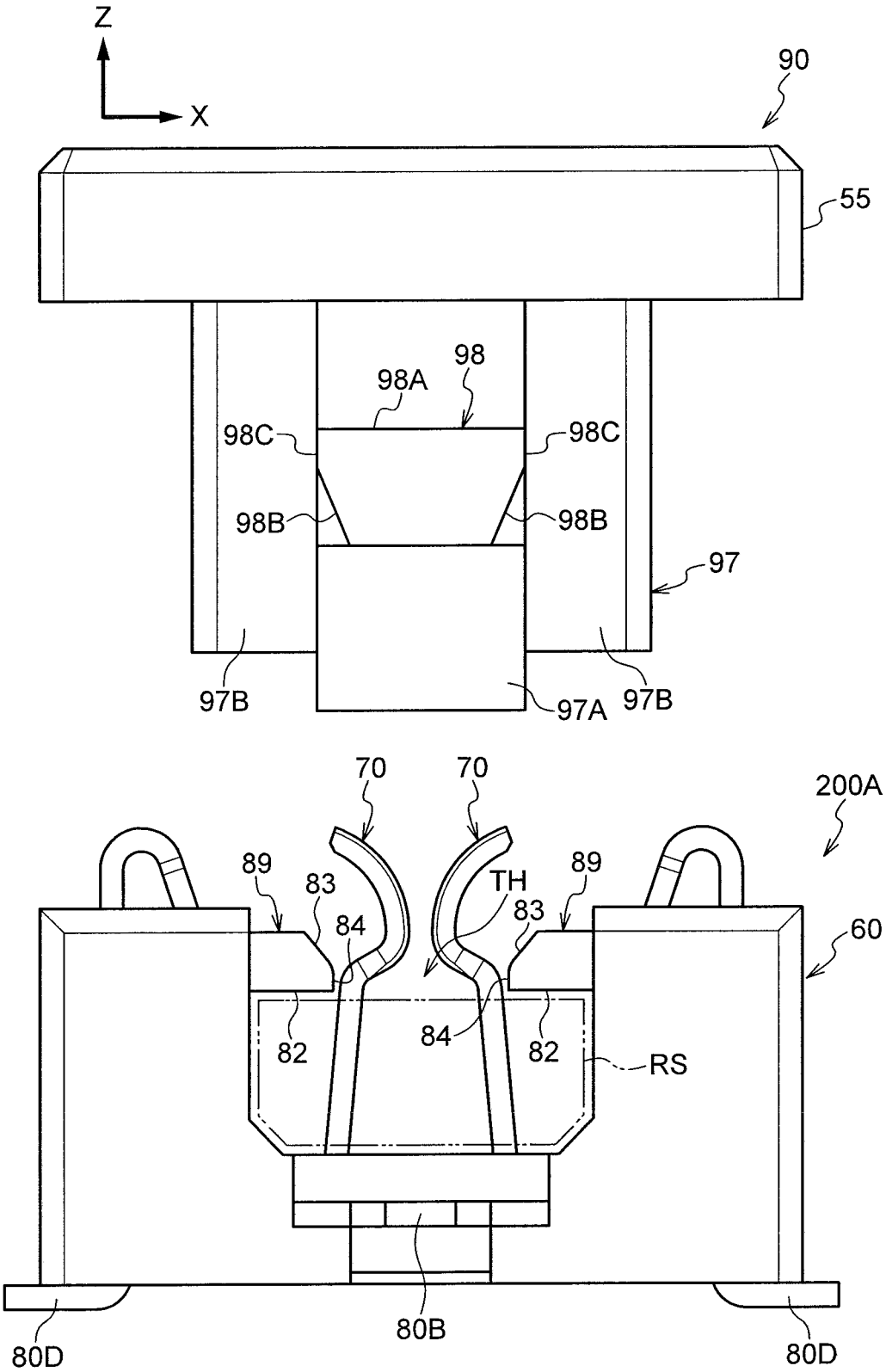
FIG. 24A is a side view illustrating a state prior to assembly in the second exemplary embodiment.
Figure 24B:
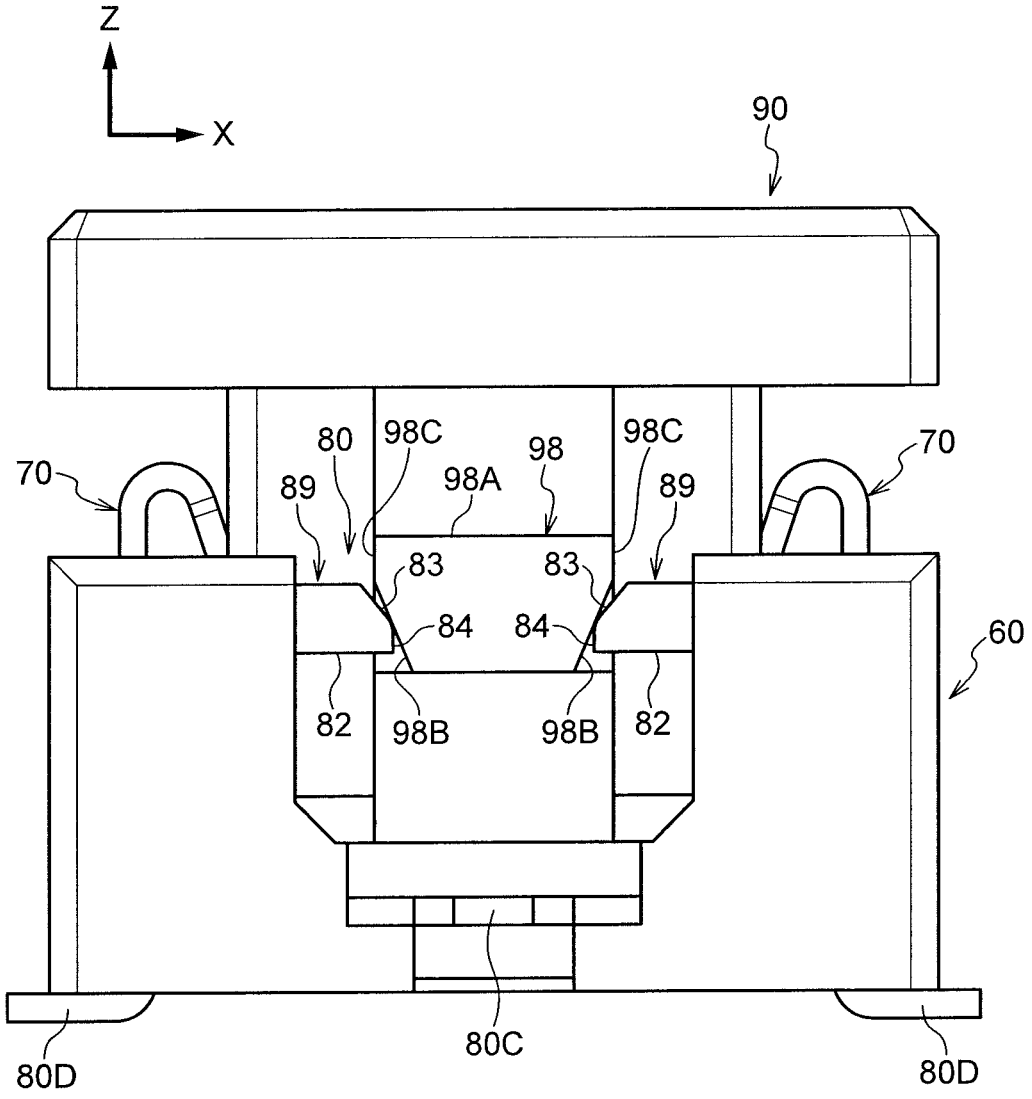
FIG. 24B is a side view illustrating a point in time that engagement portions of a movable housing contact counterpart engagement portions in an assembly process.

Specifically, as illustrated in FIG. 24A, the movable housing 90 is disposed above the work-in-progress 200A, and the movable housing 90 is then moved downward. When this is performed, as illustrated in FIG. 24B, engagement portions 98 of the movable housing 90 contact counterpart engagement portions 89 of the restriction fittings 80 of the work-in-progress 200A.

Figure 24C:
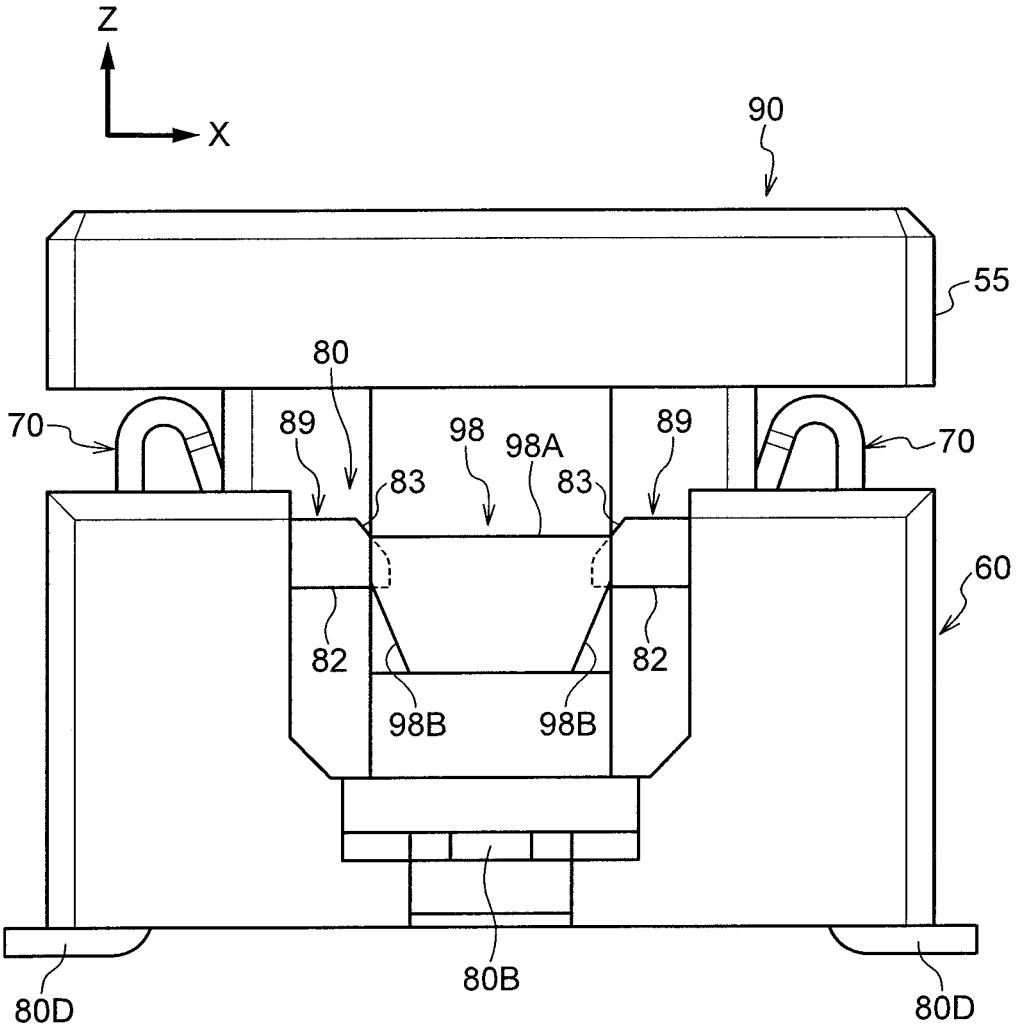
FIG. 24C is a side view illustrating a state in which counterpart engagement portions are digging into engagement portions in the assembly process.

When the movable housing 90 is then further lowered, as illustrated in FIG. 24C, leading end portions of the pair of counterpart engagement portions 89 dig into the engagement portions 98. Namely, leading end portion of the pair of counterpart engagement portions 89 cause plastic deformation to occur in the engagement portions 98 of the movable housing 90.

Figure 25:
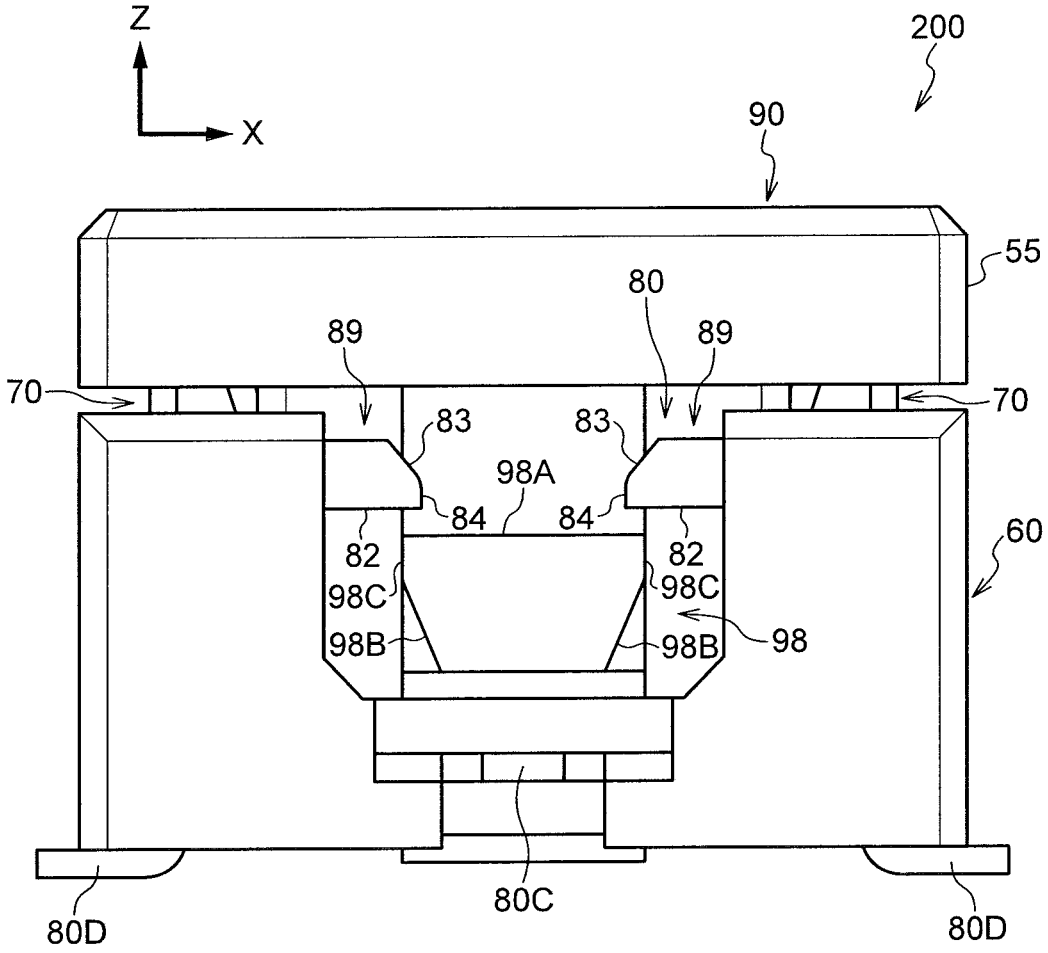
FIG. 25 is a side view illustrating a state in which the assembly process has been completed.
Figure 26:
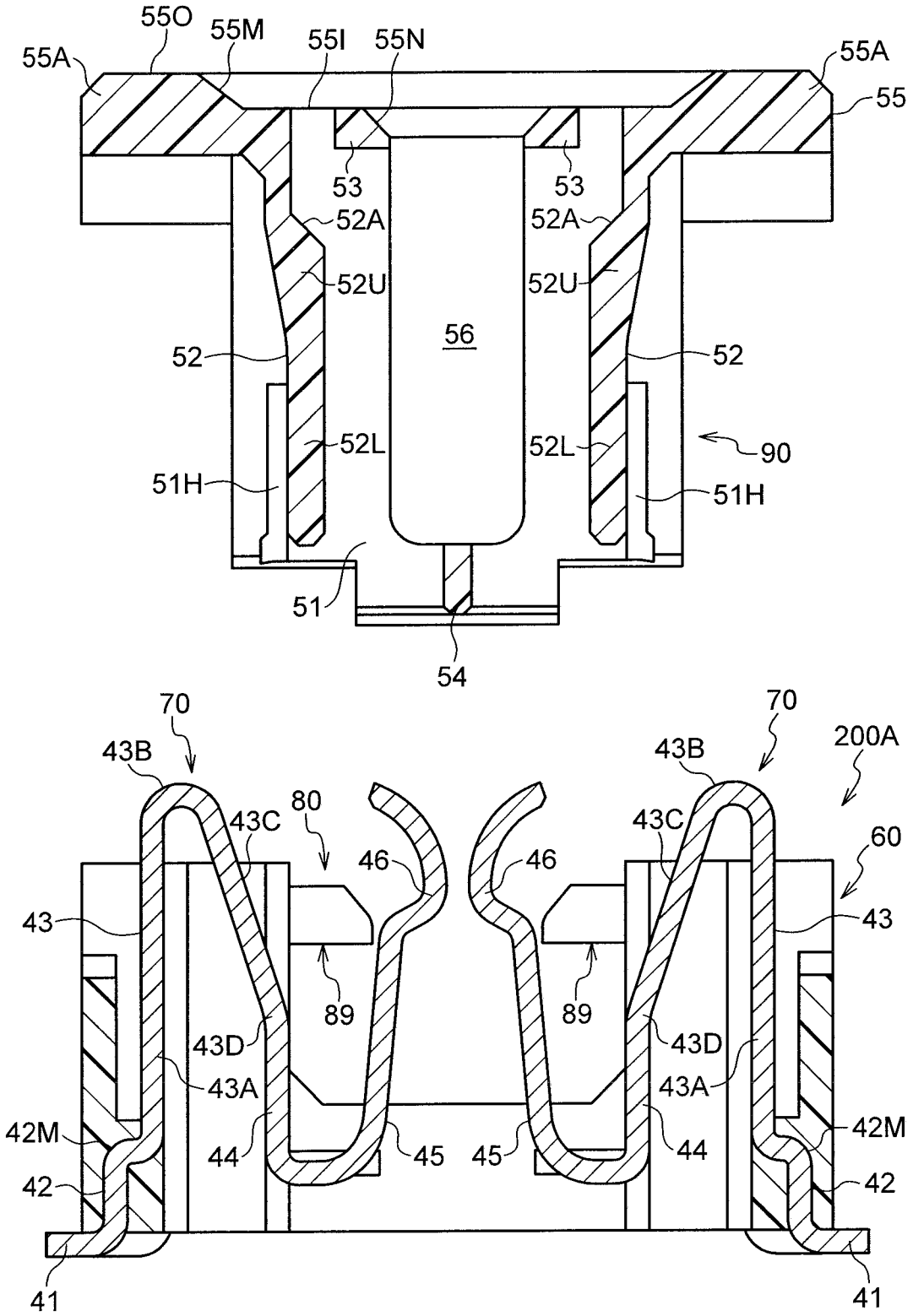
FIG. 26 is a (cross-sectional) side view illustrating a state prior to an assembly process in the second exemplary embodiment.
Figure 27:
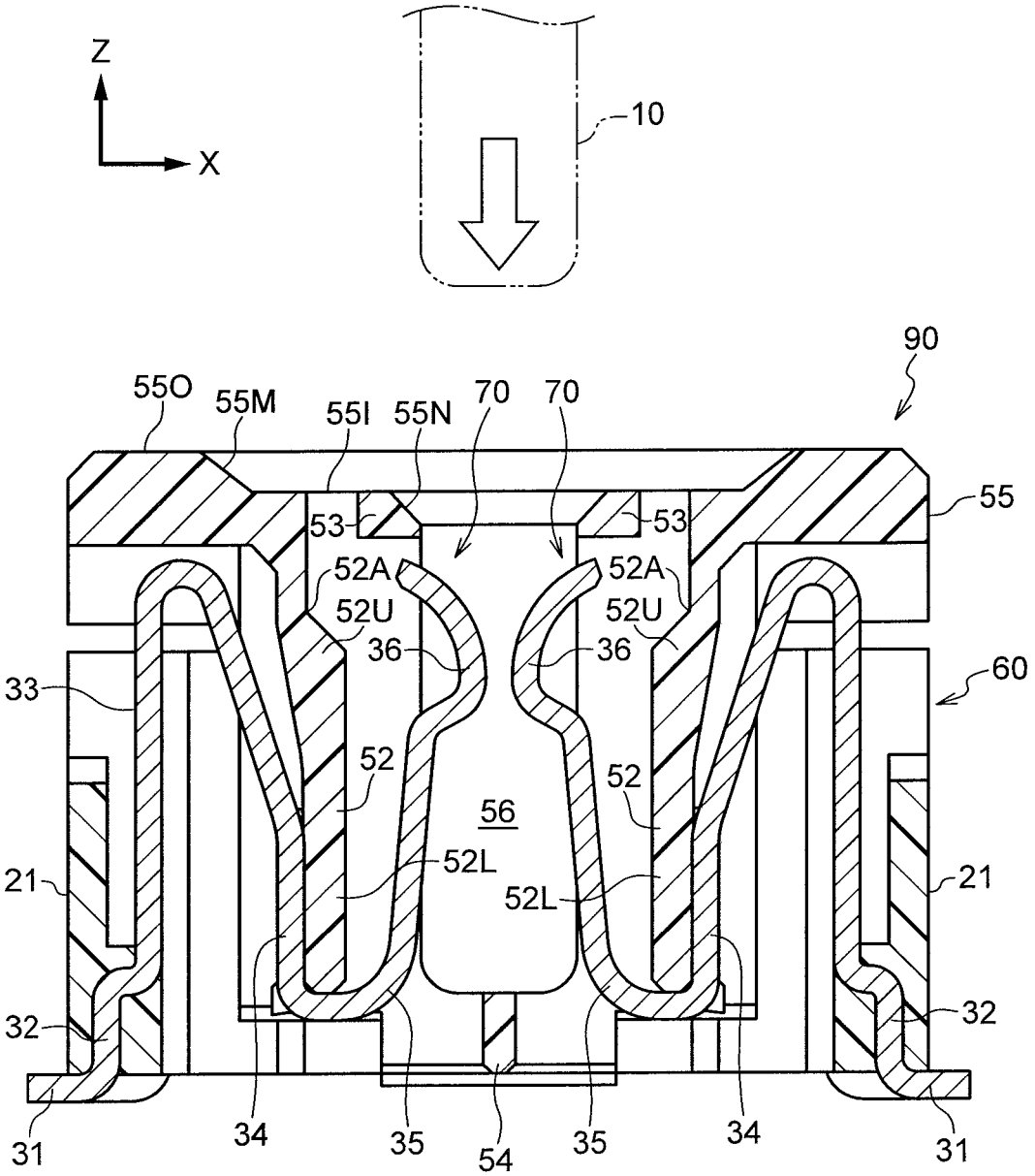
FIG. 27 is a cross-section (vertical cross-section sectioned along a connector width direction) illustrating a movable connector of the second exemplary embodiment.

When the movable housing 90 is lowered still further, the engagement portions 98 pass between the pair of counterpart engagement portions 89 (the through-pass section TH in FIG. 24A). When this occurs, as illustrated in FIG. 25, the engagement portions 98 enter a region (restraint space RS in FIG. 24A) at the lower side of the pair of counterpart engagement portions 89. Even if an upward force is applied to the movable housing 90 in this state, the movable housing 90 is not pulled out due to the engagement portions 98 contacting the pair of counterpart engagement portions 89. Namely, a state is achieved in which the engagement portions 98 are restrained to the restraint space RS and a movement range of the movable housing 90 in the connector upward direction is limited by the restriction fittings 80.

Note that in a completed state of the movable connector 200, gouged grooves 99 (FIG. 29) are formed in the engagement portions 98 corresponding to the plate thickness of the counterpart engagement portions 89 of the restriction fittings 80. However, the movable housing 90 does not come out as long there is not perfect alignment between the positions of the gouged grooves 99 and the positions of the counterpart engagement portions 89. Perfect alignment between the two members virtually never occurs. There is accordingly no problem to restrain the engagement portions 98 of the movable housing 90 in the restraint space RS without any issues occurring.

Terminals

Figure 15:
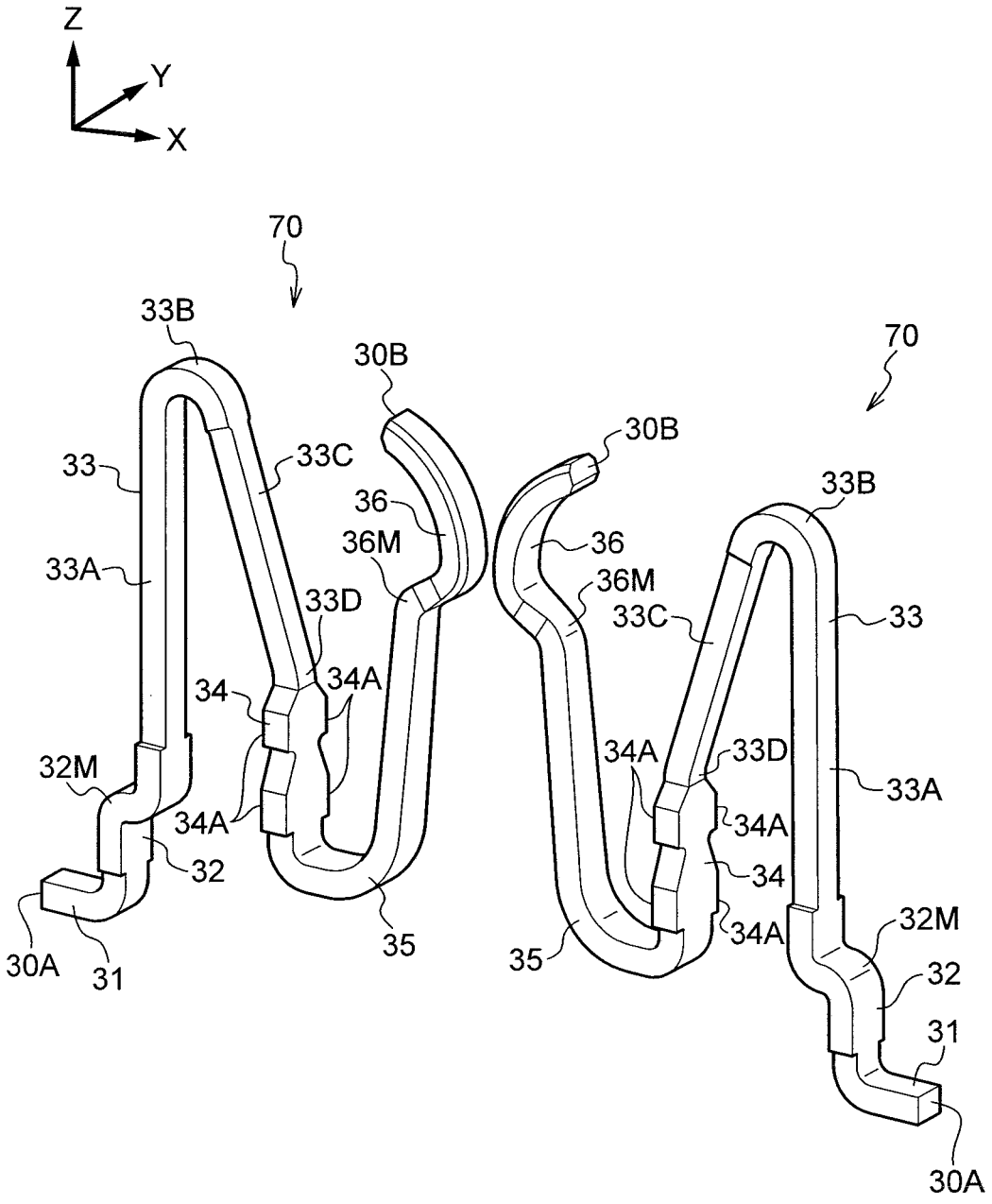
FIG. 15 is a perspective view illustrating terminals of a second exemplary embodiment.

As illustrated in FIG. 15, the configuration of the terminals 70 of the second exemplary embodiment is similar to that of the terminals 30 of the first exemplary embodiment (FIG. 1), and so they are allocated the same reference numerals and explanation thereof is omitted.

Restriction Fittings

Figure 16:
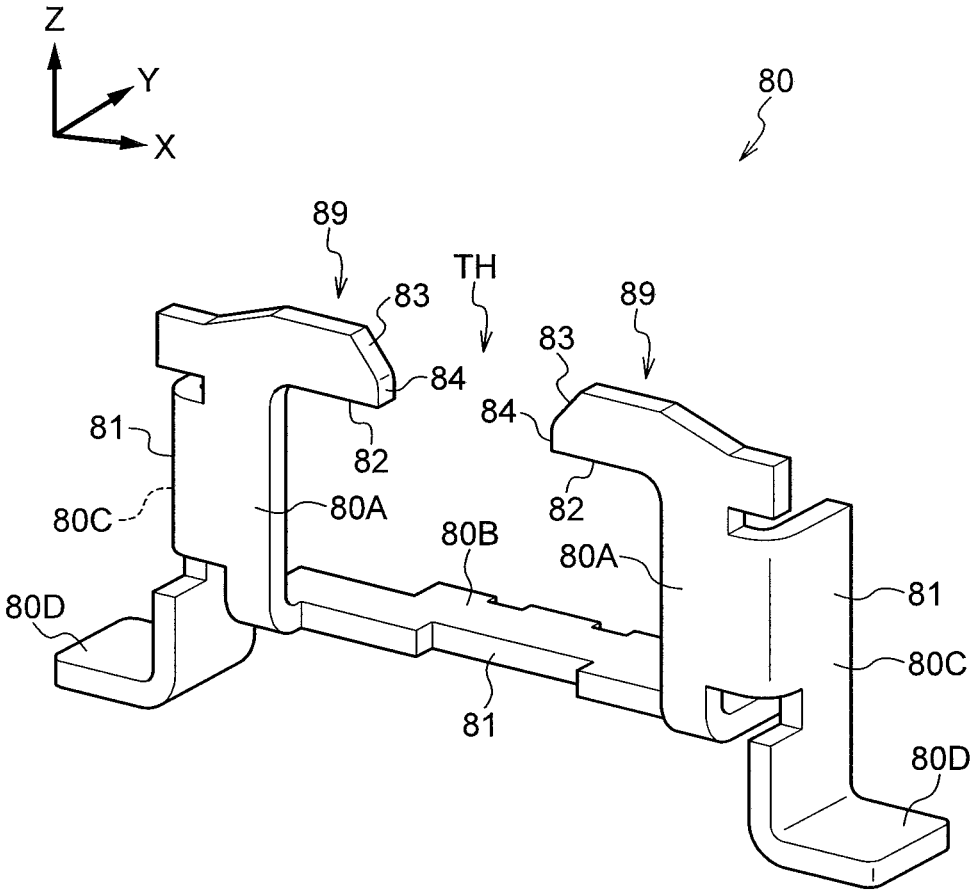
FIG. 16 is a perspective view illustrating a restriction fitting (on a connector right side) of the second exemplary embodiment.
Figure 17:
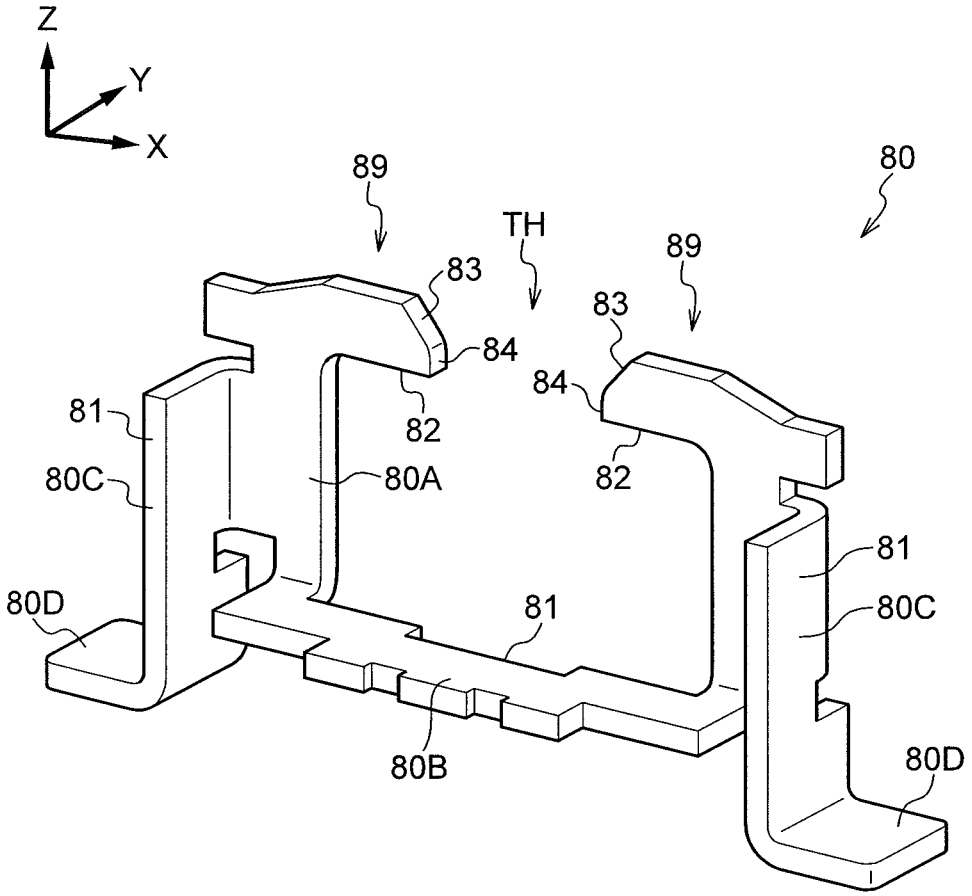
FIG. 17 is a perspective view illustrating a restriction fitting (on a connector left side) of the second exemplary embodiment.

As illustrated in FIG. 16 and FIG. 17, the configuration of the restriction fittings 80 of the second exemplary embodiment differs greatly from that of the restriction fittings 40 (FIG. 2, FIG. 3) of the first exemplary embodiment.

Two of the restriction fittings 80 are provided for each of the movable connectors 200. These two restriction fittings 80 have the same structure as each other.

Figure 28:
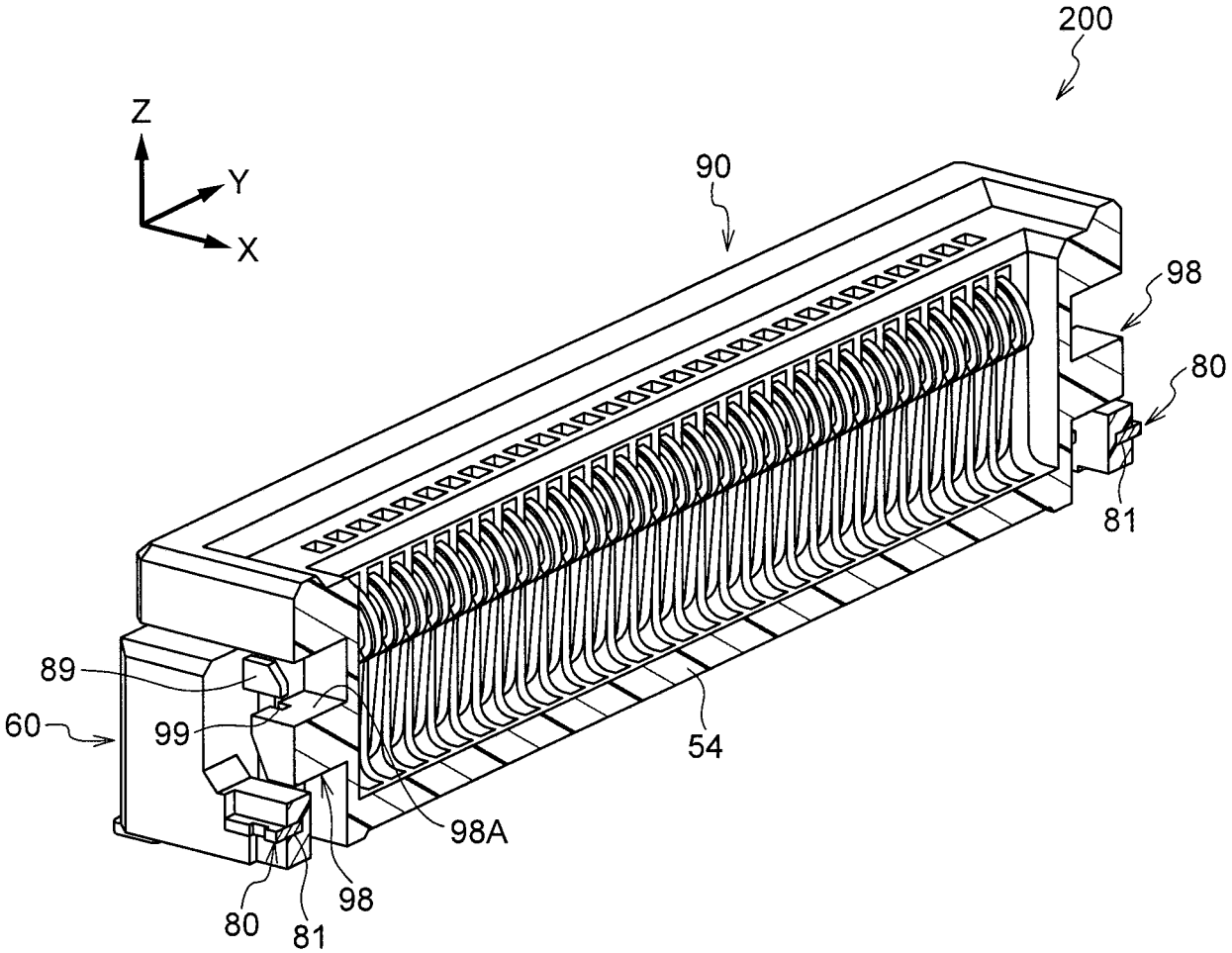
FIG. 28 is another cross-section (vertical cross-section sectioned along a connector front-rear direction) illustrating a movable connector of the second exemplary embodiment.

Each of the restriction fittings 80 includes retained portions 81 that are retained at the stationary housing 60. The restriction fittings 80 are integrated with the stationary housing 60 by insert molding to achieve a state in which the retained portions 81 are embedded in the stationary housing 60 as illustrated in FIG. 19 and FIG. 28.

The restriction fittings 80 are formed by punching out from a sheet material and then bending. As illustrated in FIG. 16 and FIG. 17, each restriction fitting 80 includes width facing portions 80A having a plate thickness direction running in the connector width direction, an up-down facing portion 80B having a plate thickness direction running in the up-down direction formed on the other side of a bent portion at a lower side of the width facing portion 80A, and front-rear facing portions 80C having a plate thickness direction running in the connector front-rear direction formed at both connector front-rear direction sides of the width facing portion 80A on the other side of bent portions. Fixed portions 80D to be fixed to the substrate by soldering or the like are formed at the lower sides of the front-rear facing portions 80C on the other side of bent portions.

The whole of the bent portions between the width facing portions 80A and the up-down facing portion 80B and the whole of the bent portions between the width facing portions 80A and the front-rear facing portions 80C end up in an embedded state in the stationary housing 60 as part of the retained portions 81 described above.

Each of the restriction fittings 80 further includes the counterpart engagement portions 89 that abut part of the movable housing 90 (the engagement portions 98) from a connector upward direction so as to limit a movement range of the movable housing 90 in the upward direction relative to the stationary housing 60.

A pair of the counterpart engagement portions 89 are provided to each restriction fitting 80. A "through-pass section TH" through which the engagement portions 98 of the movable housing 90 pass is configured between the pair of counterpart engagement portions 89. The pair of counterpart engagement portions 89 have a plate thickness direction running in the connector width direction, and form part of the width facing portions 80A described above.

In the completed state of the movable connector 200, the portions of the counterpart engagement portions 89 that abut the engagement portions 98 of the movable housing 90 are referred to as abutting portions 82. The abutting portions 82 extend parallel to the connector front-rear direction (connector horizontal direction).

Each of the counterpart engagement portions 89 includes an inclined portion 83 inclined such that a spacing between the counterpart engagement portions 89 gradually narrows on progression in the connector downward direction. The inclined portions 83 are formed to each of the pairs of the counterpart engagement portions 89.

Each of the counterpart engagement portions 89 further includes a vertical portion 84 at the lower side of the inclined portion 83. The vertical portions 84 are formed so as to be contiguous to the lower ends of the inclined portion 83. The vertical portions 84 extend along the connector up-down direction, and the spacing between the pair of counterpart engagement portions 89 does not change along the vertical portions 84.

Stationary Housing

The configuration of the stationary housing 60 of the second exemplary embodiment has substantially the same structure and function as that of the stationary housing 20 of the first exemplary embodiment (FIG. 5, FIG. 13, etc.), and is therefore allocated the same reference numerals, and explanation thereof is omitted.

Movable Housing

Configuration of the movable housing 90 of the second exemplary embodiment having substantially the same structure and function as the configuration of the movable housing 50 of the first exemplary embodiment (FIG. 8 etc.) are allocated the same reference numerals, and explanation thereof is omitted.

As illustrated in FIG. 20, the movable housing 90 includes the engagement portions 98. The engagement portions 98 are portions projecting toward the connector width direction outsides from side walls 97 of the movable housing 90.

Each of the engagement portions 98 includes an abutting portion 98A to abut the counterpart engagement portion 89 when the movable housing 90 moves in the upward direction in the completed state of the movable connector 200. The abutting portions 98A are upper faces of the engagement portions 98, and are flat surfaces having a normal direction oriented in the upward direction.

Each of the engagement portions 98 includes inclined portions 98B inclined such that a dimension of the engagement portion 98 in the connector front-rear direction (the direction in which the pair of counterpart engagement portions 89 oppose each other) gradually increases on progression in the connector upward direction. The inclined portions 98B are formed as pairs in the connector front-rear direction.

Figure 29:
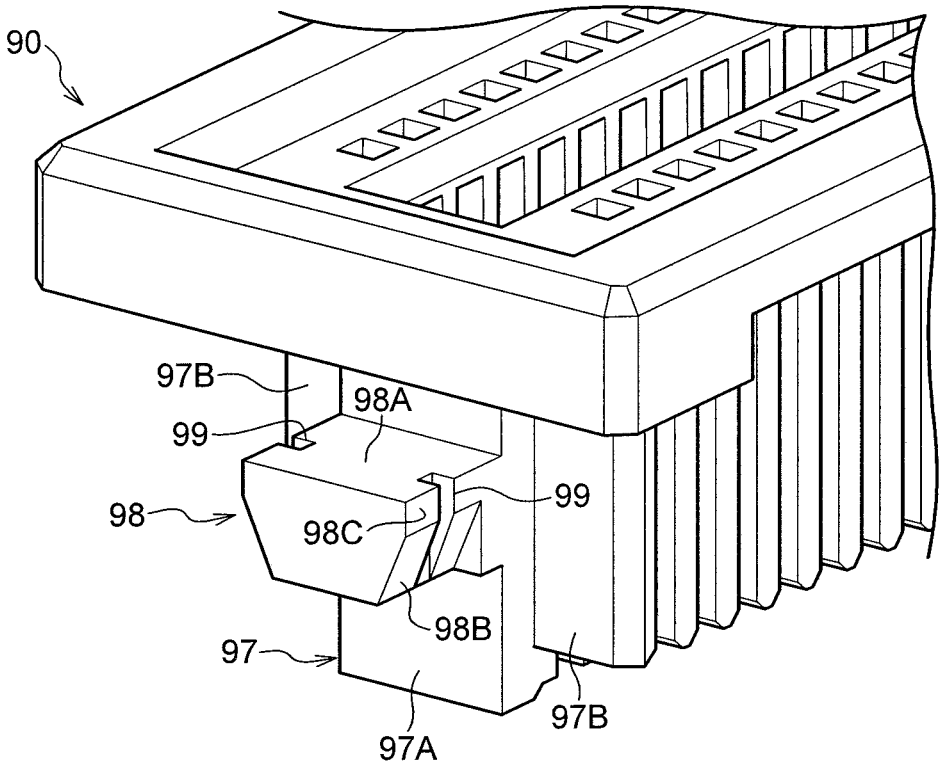
FIG. 29 is an enlarged perspective view of part of a movable housing (in a movable connector completed state) of the second exemplary embodiment.

As illustrated in FIG. 29, the side walls 97 of the movable housing 90 are configured including general portions 97A formed with the engagement portions 98 projecting therefrom, and reduced-size portions 97B, which are indented toward the connector width direction inside with respect to the general portions 97A. The reduced-size portions 97B are formed at the two connector front-rear direction sides of the general portion 97A. The reduced-size portions 97B abut the high wall portions 22S of the side walls 22 of the stationary housing 60 when the movable housing 90 has moved in the connector width direction in the completed state of the movable connector 200, thereby limiting the movement range of the movable housing 90 in the connector width direction. A large movable region of the movable housing 90 in the connector width direction is thereby achieved by forming the reduced-size portions 97B.

Operation and Advantageous Effects

Explanation follows regarding operation and advantageous effects of the present exemplary embodiment. Note that explanation is omitted regarding operation and advantageous effects originating from configuration similar to that of the first exemplary embodiment.

The movable connector 200 in the present exemplary embodiment includes the stationary housing 60 to be fixed to the substrate, the movable housing 90 that is capable of moving relative to the stationary housing 60, and the restriction fittings 80 integrated with the stationary housing 60. As illustrated in FIG. 24A, each of the restriction fittings 80 includes the counterpart engagement portions 89, and the counterpart engagement portions 89 are capable of restraining the engagement portions 98 in the restraint space RS, i.e. a predetermined region, by abutting the engagement portions 98 configuring part of the movable housing 90 from the connector upward direction.

The counterpart engagement portions 89 moreover form the through-pass section TH to permit the engagement portions 98 to pass through into the restraint space RS from the outside. Accordingly, as illustrated in FIG. 24A to FIG. 25, the movable housing 90 can be assembled by passing the engagement portions 98 of the movable housing 90 through the through-pass section TH such that the engagement portions 98 enter the restraint space RS from outside.

As described above, the movable connector 200 can be manufactured by assembling the movable housing 90 to the work-in-progress 100A after the restriction fittings 80 have been integrated with the stationary housing 60 in advance.

Moreover, in the present exemplary embodiment, as illustrated in FIG. 29, the gouged grooves 99 corresponding to the plate thickness of the counterpart engagement portions 89 of the restriction fittings 80 are formed in the engagement portions 98 of the movable housing 90. The movable connector 200 of the present exemplary embodiment can thus be manufactured by assembling the movable housing 90 to the work-in-progress 200A by plastically deforming the engagement portions 98 using the counterpart engagement portions 89.

Moreover, the engagement portions 98 in the present exemplary embodiment include the inclined portions 98B to guide the engagement portions 98 into the through-pass section TH. Accordingly, the engagement portions 98 can still be guided to an appropriate position even if the engagement portions 98 are somewhat out of position in the connector front-rear direction when the movable housing 90 is being assembled. In particular, the counterpart engagement portions 89 in the present exemplary embodiment function as blades to form the gouged grooves 99 in the engagement portions 98, so that the inclined portions 98B of the engagement portions 98 act to gradually increase the amount of digging in of the counterpart engagement portions 89 into the engagement portions 98 (the amount of digging in in the connector front-rear direction).

Moreover, in the present exemplary embodiment, the engagement portions 98 include vertical faces 98C at the upper sides of the inclined portions 98B. This thereby secures the strength of the engagement portions 98.

The counterpart engagement portions 89 in the present exemplary embodiment include the inclined portions 83 to guide the engagement portions 98 into the through-pass section TH. The engagement portions 98 can accordingly be guided to an appropriate position even if the engagement portions 98 are somewhat out of position in the connector front-rear direction when the movable housing 90 is being assembled. In particular, the counterpart engagement portions 89 in the present exemplary embodiment function as blades to form the gouged grooves 99 in the engagement portions 98, such that the inclined portions 83 of the counterpart engagement portions 89 act to gradually increase the amount by which the counterpart engagement portions 89 dig into the engagement portions 98.

Moreover, in the present exemplary embodiment, the counterpart engagement portions 89 include the vertical portions 84 at the lower sides of the inclined portions 83. This thereby enables the strength of the counterpart engagement portions 89 to be secured, enabling the assembly process to be performed in a consistent manner.

Supplementary Explanation to the Above Exemplary Embodiments

Regarding the movable connector manufacturing process, modifications may be made to the processes described in the above exemplary embodiments.

For example, the stationary housing and the restriction fittings may be first integrated together by press-fitting or the like, after which the movable housing is assembled, and then the terminals are finally retained by press-fitting into the stationary housing and the movable housing.

Alternatively, for example, the stationary housing may be first molded as a single body with the terminals by insert molding, after which the terminals may be retained at the movable housing by press-fitting or the like, and the restriction fittings may be finally integrated together with the stationary housing by press-fitting or the like.

In the exemplary embodiments described above, although explanation has been given regarding a movable connector having multiple terminals 30, 70 arrayed therein, the present disclosure is not limited thereto. For example, the movable connector may be provided with a single terminal.

In the exemplary embodiments described above, although explanation has been given regarding an example in which the movable connector is for mounting to the substrate by reflow soldering, the present disclosure is not limited thereto.

In the exemplary embodiment described above, although explanation has been given regarding the movable housing 50 having the complex shape illustrated in FIG. 6, the present disclosure is not limited thereto.

In the exemplary embodiments described above, although explanation has been given regarding examples in which the restriction fittings 40, 80 also function as fixing fittings to be fixed the stationary housing 20, 60 to the substrate, the present disclosure is not limited thereto. For example, the restriction fittings do not need to function as fixing fittings (i.e. fixing fittings may be provided separately to the restriction fittings).

In the exemplary embodiments described above, although explanation has been given regarding examples in which the movable housing 50, 90 are configured entirely by a molded resin body with the engagement portions 58, 98 configuring part of the molded resin body, the present disclosure is not limited thereto. For example, the movable housing may be configured by a molded resin body and fittings fixed to the molded resin body, with the fittings functioning as engagement portions.

EXPLANATION OF THE REFERENCE NUMERALS

100 movable connector
100A work-in-progress
20 stationary housing
30 terminal
32 stationary-side retained portion
33 movable portion
34 movable-side retained portion
40 restriction fitting
43 upward-extending portion
44 bent portion (folded portion)
45 inclined portion (folded portion)
46 vertical portion (folded portion)
46L lower end of vertical portion (leading end of folded portion, abutting portion)
47 through hole
47U upper edge of through hole (abutting portion)
48 abutting portion
49 counterpart engagement portion
50 movable housing
57 side wall
58 engagement portion
58A abutting portion
58B inclined portion
200 movable connector
200A work-in-progress
60 stationary housing
70 terminal
80 restriction fitting
83 inclined portion
89 counterpart engagement portion
90 movable housing
97 side wall
98 engagement portion
98B inclined portion
99 gouged groove

The invention claimed is:

1. A movable connector comprising:

a stationary housing to be fixed to a substrate;

a movable housing capable of moving relative to the stationary housing; and a restriction fitting that has been formed separately from the stationary housing and has been integrated with the stationary housing, the restriction fitting including a substrate fixing portion to be fixed to the substrate, wherein:

the restriction fitting includes a counterpart engagement portion, the counterpart engagement portion being configured to abut an engagement portion that is part of the movable housing from a connector upward direction so as to enable the engagement portion to be restrained in a restraint space that is a predetermined region, and the counterpart engagement portion forms a through-pass section to permit the engagement portion to pass into the restraint space from outside.

2. The movable connector of claim 1, wherein:

the movable connector further comprises a terminal including:

a stationary-side retained portion retained at the stationary housing, a movable-side retained portion retained at the movable housing, and an elastically deformable movable portion positioned between the stationary-side retained portion and the movable-side retained portion;

retention of the stationary-side retained portion with respect to the stationary housing is achieved by performing insert molding; and retention of the movable-side retained portion with respect to the movable housing is achieved by performing press-fitting.

3. The movable connector of claim 1, wherein the stationary housing and the restriction fitting are integrated together by insert molding.

4. The movable connector of claim 1, wherein the engagement portion includes an inclined portion to guide the engagement portion into the through-pass section.

5. The movable connector of claim 1, wherein the counterpart engagement portion includes an inclined portion to guide the engagement portion into the through-pass section.

6. The movable connector of claim 1, wherein the restriction fitting is deformable so as to widen the through-pass section.

7. A movable connector comprising:

a stationary housing to be fixed to a substrate;

a movable housing capable of moving relative to the stationary housing; and a restriction fitting that has been integrated with the stationary housing, wherein:

the restriction fitting includes a counterpart engagement portion, the counterpart engagement portion being configured to abut an engagement portion that is part of the movable housing from a connector upward direction so as to enable the engagement portion to be restrained in a restraint space that is a predetermined region, and the counterpart engagement portion forms a through-pass section to permit the engagement portion to pass into the restraint space from outside;

wherein the restriction fitting is deformable so as to widen the through-pass section;

wherein the restriction fitting includes:

an upward-extending portion extending toward the connector upward direction and having a plate thickness direction tilted by deformation of the restriction fitting; and a folded portion formed by folding a leading end side of the upward-extending portion back toward the through-pass section.

8. The movable connector of claim 7, wherein the folded portion includes an inclined portion inclined toward the through-pass section on progression toward a connector downward direction.

9. The movable connector of claim 7, wherein:

the plate thickness direction of the upward-extending portion is oriented in a connector width direction; and the engagement portion is configured so as not to abut the upward-extending portion from the connector width direction by a through hole being formed in the upward-extending portion.

10. The movable connector of claim 9, wherein a lower end of the folded portion and an upper edge of the through hole together configure an abutting portion that abuts the movable housing and limits a movement range of the movable housing in the connector upward direction.

11. The movable connector of claim 7, wherein the folded portion is configured including a vertical portion having a plate thickness direction oriented in a connector width direction and contacting a side wall of the movable housing.

12. A movable connector comprising:

a stationary housing to be fixed to a substrate;

a movable housing capable of moving relative to the stationary housing; and a restriction fitting that has been integrated with the stationary housing, wherein:

the restriction fitting includes a counterpart engagement portion, the counterpart engagement portion being configured to abut an engagement portion that is part of the movable housing from a connector upward direction so as to enable the engagement portion to be restrained in a restraint space that is a predetermined region, and the counterpart engagement portion forms a through-pass section to permit the engagement portion to pass into the restraint space from outside;

wherein a gouged groove corresponding to a plate thickness of the counterpart engagement portion is formed in the engagement portion.

* * * * *